US007322518B2

(12) United States Patent
Yokoi et al.

(10) Patent No.: US 7,322,518 B2
(45) Date of Patent: Jan. 29, 2008

(54) BILL DEPOSITING/DISPENSING APPARATUS

(75) Inventors: Toshinori Yokoi, Nagakute (JP); Atsuko Uozumi, Owariasahi (JP); Riichi Kato, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 11/802,957

(22) Filed: May 29, 2007

(65) Prior Publication Data

US 2007/0228151 A1 Oct. 4, 2007

Related U.S. Application Data

(63) Continuation of application No. 11/132,302, filed on May 19, 2005, now Pat. No. 7,249,707.

(30) Foreign Application Priority Data

Jun. 1, 2004 (JP) ..... 2004-162944
Mar. 9, 2005 (JP) ..... 2005-65062

(51) Int. Cl.
*G07F 19/00* (2006.01)

(52) U.S. Cl. ..... 235/379; 235/381; 902/8; 902/12; 902/13

(58) Field of Classification Search ..... 235/379, 235/381; 902/8, 9, 11, 13, 17
See application file for complete search history.

(56) References Cited

U.S. PATENT DOCUMENTS 5,880,444 A 3/1999 Shibata
6,540,136 B1 4/2003 Ross
2001/0013541 A1 8/2001 Modi
2002/0170955 A1 11/2002 Hagglund
2002/0170956 A1 11/2002 Katou
2004/0173672 A1 9/2004 Washington

FOREIGN PATENT DOCUMENTS

CN 1161720 (1261194) 7/2000
EP 1363251 11/2003
EP 1603085 12/2005
JP 2000-020783 1/2000
JP 2000-172946 6/2000

*Primary Examiner*—Michael G. Lee
*Assistant Examiner*—Kristy A. Haupt
(74) *Attorney, Agent, or Firm*—Antonelli, Terry, Stout & Kraus, LLP.

(57) ABSTRACT

A bill depositing/dispensing apparatus being fitted with a plurality of storing boxes for storing bills including a deposited bill box, an outgoing bill box, a recycle box, and an acceptance box with multi-compartments for sorted storing of bills. The acceptance box has a fitting mechanism common to at least one of a fitting mechanism of the deposited bill box, the outgoing bill box and the recycle box, and has a slot in a same position to at least one of the deposited bill box, the outgoing bill box and the recycle box. Further, the acceptance box has a plurality of storages for storing bills conveyed in through a common slot, and are arranged in a horizontal direction within the acceptance box. At least two storages of the plurality of storages are arranged with an inclination in a same direction relative to a bottom surface of the acceptance box.

17 Claims, 16 Drawing Sheets

FIG. 11

| | EXAMPLE OF OPERATION (TRANSACTIONS IN EUROS) | | |
|---|---|---|---|
| | (A) | (B) | (C) |
| | MORE WITHDRAW | MORE DEPOSIT | UNDER STRICT CASH MANAGEMENT |
| TIRE 1 | DEPOSIT BOX | DEPOSIT BOX | 1ST OR 2ND MULTI-PARTITIONED ACCEPTANCE BOX |
| TIRE 2 | RECYCLE BOX (10 EUROS) | DEPOSIT BOX | 1ST OR 2ND MULTI-PARTITIONED ACCEPTANCE BOX |
| TIRE 3 | RECYCLE BOX (20 EUROS) | DEPOSIT BOX | RECYCLE BOX (20 EUROS) |
| TIRE 4 | RECYCLE BOX (50 EUROS) | RECYCLE BOX (20 EUROS) | RECYCLE BOX (50 EUROS) |
| TIRE 5 | RECYCLE BOX (100 EUROS) | RECYCLE BOX (50 EUROS) | RECYCLE BOX (100 EUROS) |

BILL DEPOSITING/DISPENSING APPARATUS

CROSS REFERENCE TO RELATED APPLICATION

This application is a continuation application of U.S. application Ser. No. 11/132,302, filed May 19, 2005 now U.S. Pat. No. 7,249,707, the contents of which are incorporated herein by reference.

This application claims the benefit of priority of Japanese Application No. 2004-162944 filed Jun. 1, 2004 and No. 2005-65062 filed Mar. 9, 2005, the disclosure of which are entirely incorporated herein by reference.

BACKGROUND OF THE INVENTION

The present invention relates to a bill depositing/dispensing apparatus, and more particularly to, for instance, an automated teller machine for use by financial institutions and the like, to which is applied a bill depositing/dispensing apparatus which enables general consumers to directly deposit cash with or withdraw cash from by using a card, passbook or the like.

Known bill depositing/dispensing apparatuses for use by financial institutions and the like for instance include ones each of which is provided with a cash slot through which bills put in by users are to be accepted and bills to be paid to users are fed, a bill discriminator for discriminating bills and a bill conveyor which passes the bill discriminator and conveys bills. Its configuration may further include a combination of such units as a temporary stocker for temporarily storing deposited bills, a deposited bill box for storing deposited bills, an outgoing bill box for feeding bills to be withdrawn, a recycle box for storing and feeding bills deposited or to be fed, a reject box for storing deposited bills to be stored neither in the deposited bill box nor the recycle box and bills not to be dispensed out of the bills fed by the outgoing bill box, and a loading/recovering box for feeding bills to load the recycle box and bills recovered from the recycle box. In addition, there are proposed various other configurations in which the arrangement of constituent units and/or overall structure are modified in one way or another.

Especially in international markets where diverse bills are handled, there is a keen demand for bill depositing/dispensing apparatuses configured to be capable of handling many different denominations of bills. Known bill depositing/dispensing apparatuses capable of handling many different denominations of bills include, for instance, one disclosed in Patent Reference 1. This known example has a configuration including a cash slot for deposited bills, another for bills to be dispensed, a bill discriminator (bill distinguishing device) and plural recycle boxes, one for each type of bill, and these units are connected by a bill conveyor. Additional recycle boxes can be installed as additional types of bills are to be accepted. Patent Reference 2 discloses a similar example.

[Patent Reference 1] Japanese Published Unexamined Patent Application No. 2000-172946

[Patent Reference 2] Japanese Published Unexamined Patent Application No. 2000-20783

SUMMARY OF THE INVENTION

In European, American and Southeast Asian countries, supply of large-capacity bill depositing/dispensing apparatuses capable of five or more different kinds of bills is called for.

On the other hand, there are desires, out of consideration for strict cash management, for separate handling of bills rejected at the time of depositing and when they are to be dispensed otherwise, and for separate handling of bills unfit for recycling, such as smeared bills, broken bills (deformed bills) and apparently counterfeit bills, as distinguished from recyclable bills.

To enable the bill depositing/dispensing apparatuses disclosed in Patent Reference 1 and Patent Reference 2 cited above to meet these requirements, those different kinds of bills can be allocated to different storing boxes, but this would entail such problems that the variety of recyclable bills would be narrowed and a large-capacity storing box would have to be inefficiently used for separately storing only a small number of bills.

In addition, it is also necessary to take care of withdrawn bills left behind by users, but allocating a large-capacity storing box merely for the purpose handling them without mixing them with other bills in the apparatus would be too inefficient. To avoid this inefficiency, the usually adopted method is to keep left-behind bills in the cash slot and suspend further transaction instead of providing a separate storing box for left-behind bills.

An object of the present invention is to provide a convenient bill depositing/dispensing apparatus which can easily adapt itself to a way of operation by which a large number and/or a great variety of bills are handled and another by which a small number of bills are handled discriminatively.

In order to solve the problems noted above, a bill depositing/dispensing apparatus according to the invention is fitted with plural storing boxes for storing bills, the bill depositing/dispensing apparatus being fitted with a deposited bill box for storing deposited bills, an outgoing bill box for storing bills to be dispensed, a recycle box for storing both deposited bills and bills to be dispensed, and at least one kind of acceptance box with multi-compartments for sorted storing of bills, wherein these storing boxes have common external dimensions, an inlet/outlet for bills in a common position and a common conveyance drive unit and are configured to be interchangeable with one another, and the single acceptance box with multi-compartments has plural storages into which bills can be conveyed through the common slot/outlet.

For instance, an acceptance box with multi-compartments having plural storages capable of sorted storing of bills is made available in addition to a large-capacity deposited bill box for storing deposited bills, a recycle box for storing both deposited bills and bills to be dispensed, and a loading/recovering box for replenishing the recycle box with bills and recovering bills from it. By making these storing boxes detachable and providing them with the same inlet/outlet, external shape and drive unit, they are made interchangeable and capable of being flexibly combined with one another.

Another feature of the invention consists in that the single acceptance box with multi-compartments in the bill depositing/dispensing apparatus has three to five independent storages permitting sorted storing of bills.

As the acceptance box with multi-compartments has three to five independent storages permitting sorted storing of bills, a space-efficient storage in which to handle bills left behind by the user without being mixed with other cash in the apparatus may be secured as desired, and continuation of transactions is made possible even when the user has left behind withdrawn bills.

Another feature of the invention consists in that the plural storages include a first storage which is inclined upward by 10 degrees to 30 degrees as viewed from the bill conveying side and into which bills are stored sideways from the lower part. The inclination of the storage prevents the bills from falling forward and enables the structure to be simplified. This makes possible disposition of plural storages in a single storing box.

Another feature of the invention consists in that the plural storages include a throw-in type first storage so configured that bills be stored sideways from the lower part, a conveyance path disposed underneath the first storage, and a second storage which is arranged deepest inside the acceptance box with multi-compartments and has a greater space than the first storage and into which bills are stored sideways from the upper part. This makes it possible to provide a compact bill depositing/dispensing apparatus having three to five independent storages and capable of efficiently sort various kinds of bills according the quantity of each kind handled.

Another feature of the invention consists in that the bill depositing/dispensing apparatus to which plural storing boxes for storing bills are to be fitted has a recycle box for storing both deposited bills and bills to be dispensed and an acceptance box with multi-compartments for sorted storing of bills, wherein the acceptance box with multi-compartments includes a first storage and a second storage into which bills are conveyed and stored through a common slot, and the second storage has a keep plate to support the surface of bills and controls, when the bills are to be stacked, the movement of the keep plate by maintaining a prescribed storing space.

In a preferable example, the second storage of acceptance box with multi-compartments stores unrecycled bills not to be stored in the recycle box.

It is also preferable for the second storage of acceptance box with multi-compartments to have a keep plate to support the surface of bills and so moves, when the bills are to be stacked, the keep plate as to maintain a prescribed storing space.

In a further preferable example, a stacking guide is provided on the face opposite the keep plate and, when the stacking of bills has been completed, the keep plate is so driven as to be moved toward the stacking guide.

An automated teller machine using a bill depositing/dispensing safe according to the invention should preferably include a recycle box and an acceptance box with multi-compartments as storing boxes for bills, wherein the acceptance box with multi-compartments is arranged over the recycle box, and these storing boxes have a lower bill handling mechanism fitted in linkage to a common conveyance path, and an upper bill handling mechanism arranged above the lower bill handling mechanism and including a manipulating unit to be manipulated by the user, a cash slot through which the user deposits or withdraws bills, a conveyance path for conveying bills to the cash slot and linked to the conveyance path of the lower bill handling mechanism, and a bill validator arranged on the conveyance path.

The invention makes it possible to flexibly configure and install storing boxes to be adaptable to different ways of operation, and thereby to realize a bill depositing/dispensing apparatus capable of readily meeting diverse needs of users.

BRIEF DESCRIPTION OF THE DRAWINGS

FIG. 11 shows an example of combination of storing boxes classified by the way of operation;

DESCRIPTION OF THE PREFERRED EMBODIMENTS

A preferred embodiment of the invention will be described in detail below with reference to the accompanying drawings.

Figure 2:
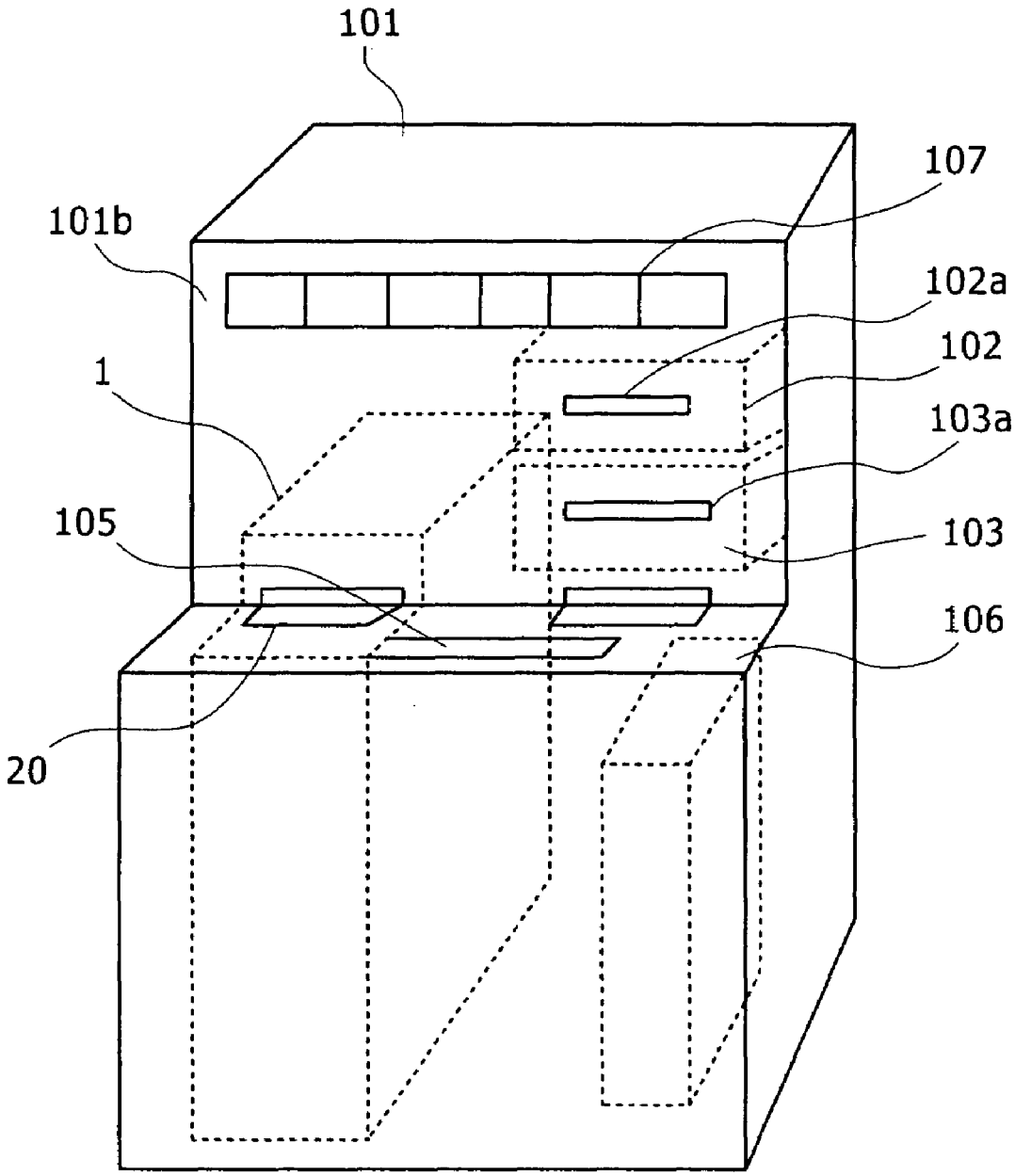
FIG. 2 is an external perspective view showing an automated teller machine.

First, FIG. 2 is an external perspective view showing an automated teller machine, which is the embodiment of the invention.

In the upper part of the main body case 101 of the automated teller machine, there are provided a card/slip processing mechanism 102 which communicates with a card slot 102*a* cut in the upper front panel 101*b* of this case 101, processes the card of each user, and prints and discharges a transaction slip, and a passbook processing mechanism 103 which communicates with a passbook slot 103*a* and processes the passbook of each user. The lower part of the main body case 101 houses a bill depositing/dispensing mechanism 1 which processes bills deposited or to be dispensed through a cash slot 20, while the middle part is provided with a customer-operable unit 105 which displays and inputs the particulars of each transaction. Reference numeral 106 denotes a main controller taking charge of control over the whole automated teller machine, and 107 denotes a transaction display indicating to the user the types of available transactions, such as depositing and withdrawal.

Figure 3:
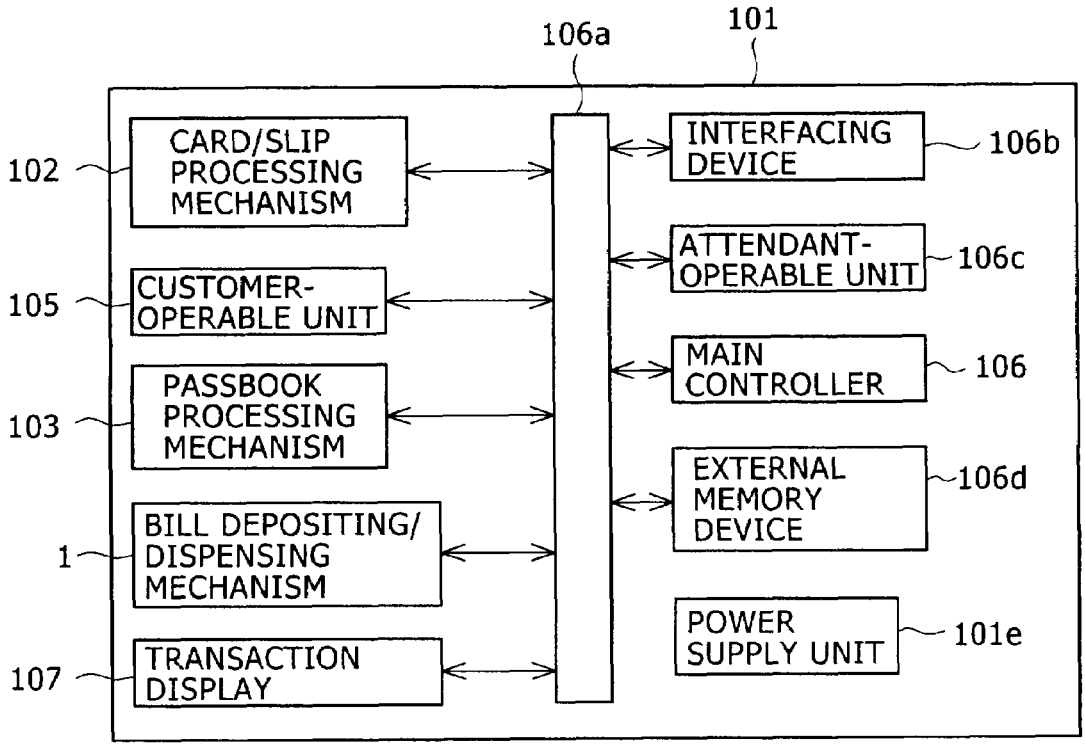
FIG. 3 is a block diagram showing the control relationship of the automated teller machine shown in FIG. 2.

FIG. 3 is a functional block diagram showing the overall configuration of the control system for this apparatus. The control system, built up around a computer, includes a card/slip processing mechanism 102 housed in the main body case 101, a passbook processing mechanism 103, a bill depositing/dispensing mechanism 1 and a customer-operable unit 105, all connected to a main controller 106 via a bus 106*a*, and perform required operations under the control of the main controller 106. This main controller 106 is also connected to an interfacing device 106*b*, an attendant-operable unit 106*c* and an external memory device 106*d* via the bus 106*a* in addition to the aforementioned elements, and exchange necessary data with them. Information regarding the types and fitting positions of the storing boxes to be installed, the type of bills to be stored in each storing box and other factors is entered by an attendant into the main controller 106 via the attendant-operable unit 106*c*. Reference sign 101*e* denotes a power supply unit for supplying electricity to the mechanisms and constituent parts of the main body case 101.

Figure 4:
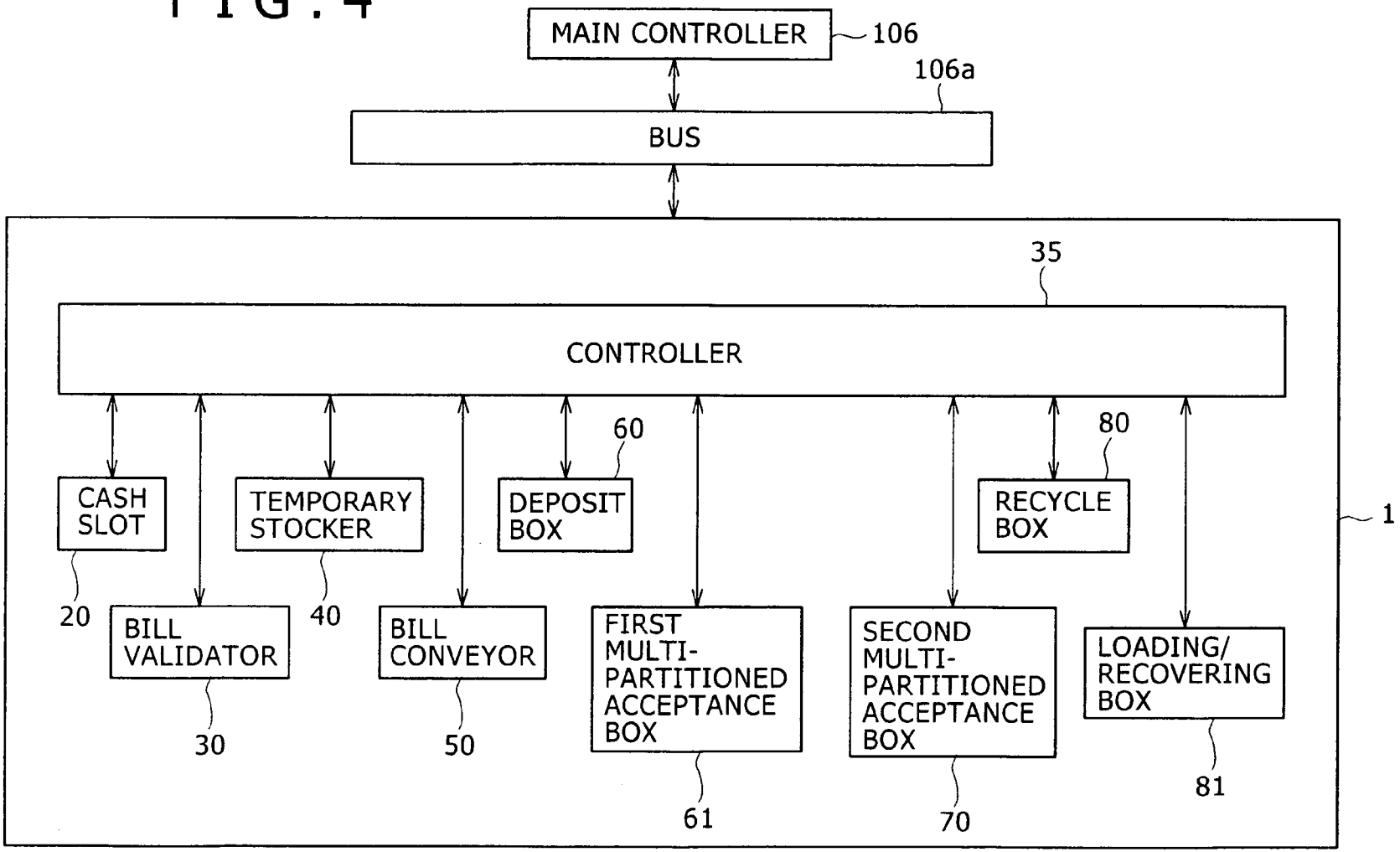
FIG. 4 is a block diagram showing the control relationship of the bill depositing/dispensing apparatus.
Figure 5:
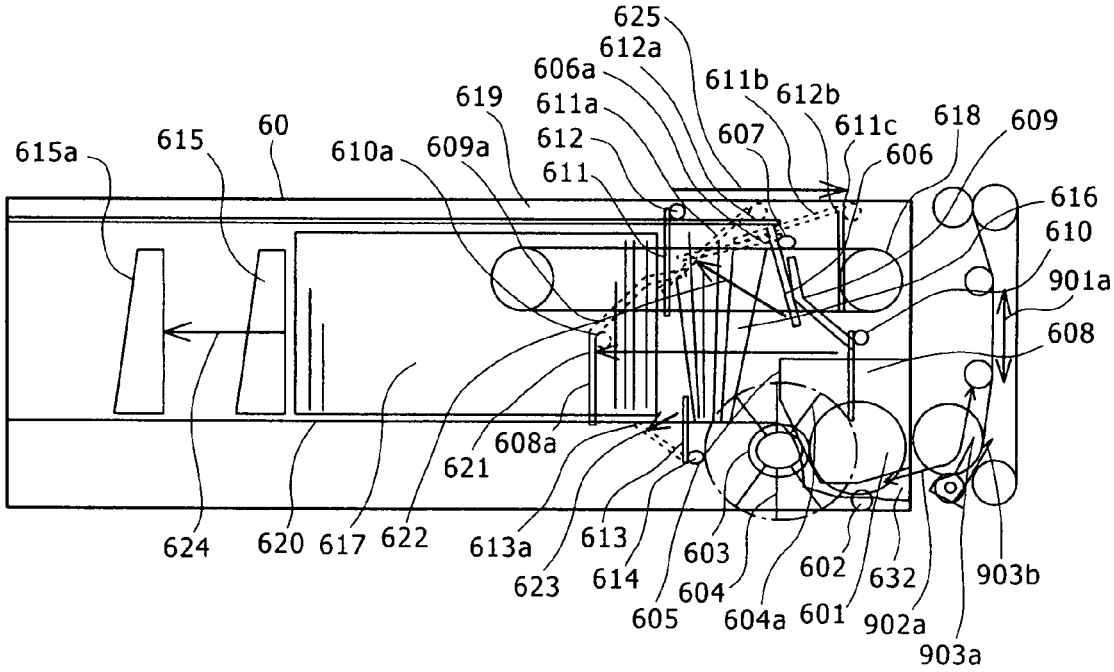
FIG. 5 is a profile showing a deposited bill box.
Figure 6:
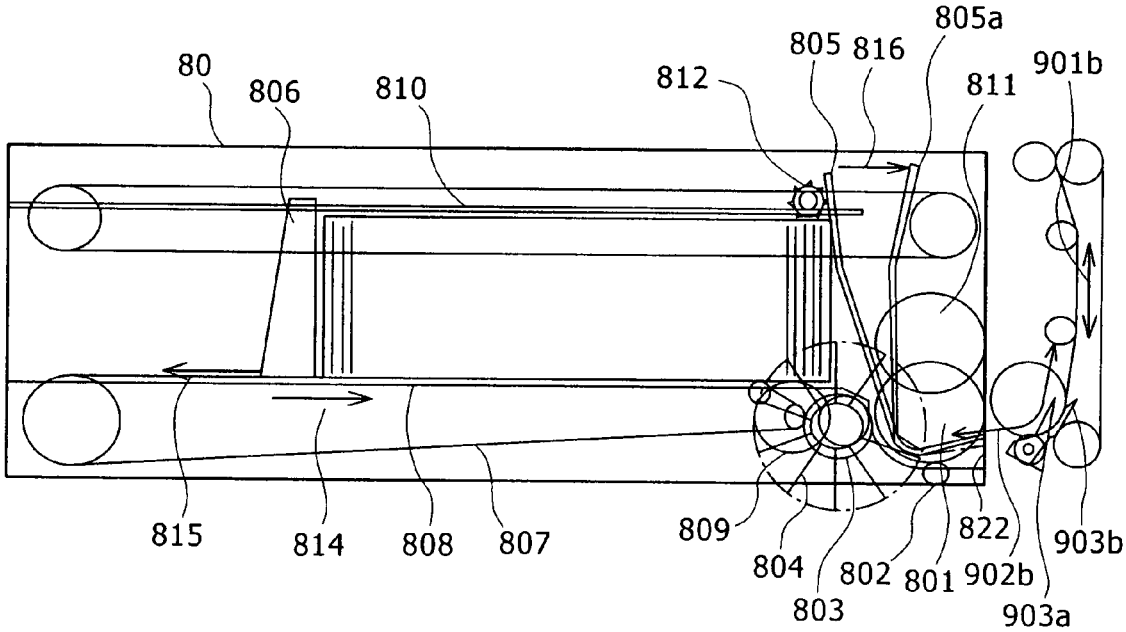
FIG. 6 is a profile showing a recycle box.

The bill depositing/dispensing apparatus 1 includes, as shown in FIG. 4, a cash slot 20 through which the user deposits or withdraws bills, a bill validator 30 which discriminates bills, plural types of detachable storing boxes for storing bills, a bill conveyor 50, and a controller 35 for controlling these mechanisms.

The variety of storing boxes include a temporary stocker 40 for temporarily storing deposited bills until the pertinent transaction is concluded, a deposited bill box 60 for storing bills not to be recycled, a first acceptance box with multi-compartments 61 capable of discriminately managing rejected bills, a second acceptance box with multi-compartments 70 capable of storing multiple kinds of deposited bills discriminated from one another, recycle boxes 80 for storing both bills deposited and bills to be dispensed, and a loading/recovering box 81 for storing bills to replenish the recycle boxes 80 and bills recovered from the recycle boxes 80.

The controller 35, connected to the main controller 106 of the automated teller machine via the bus 106*a*, controls the bill depositing/dispensing apparatus 1 at an instruction from the main controller 106 or in response to detection of the state of the bill depositing/dispensing apparatus 1. It also informs the main controller 106 of the state of the bill depositing/dispensing apparatus 1 as required. The controller 35, connected in the bill depositing/dispensing apparatus 1 to the driving motors, electromagnetic solenoids and sensors of various units including the cash slot 20, bill validator 30, temporary stocker 40, bill conveyor 50, deposit box 60, first acceptance box with multi-compartments 61, second acceptance box with multi-compartments 70, recycle boxes 80 and loading/recovering box 81, drives and controls an actuator pertinent to the transaction under way while monitoring the state with sensors.

Figure 1:
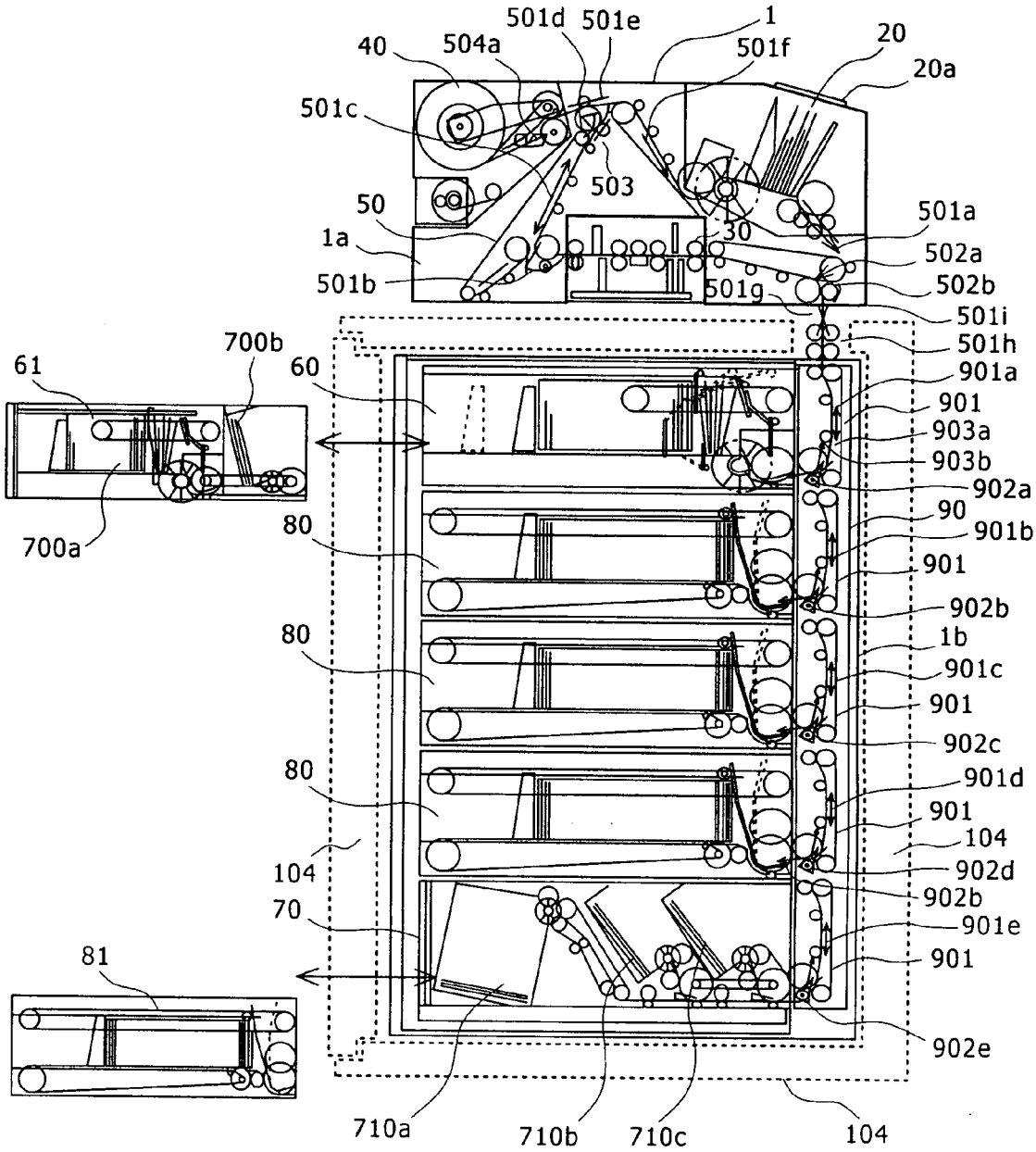
FIG. 1 is a profile showing a bill depositing/dispensing mechanism.

FIG. 1 is a profile showing an expanded view of the part of the automated teller machine in FIG. 2 constituting the bill depositing/dispensing apparatus 1.

As shown in FIG. 1, the bill depositing/dispensing apparatus 1 includes an upper bill conveyance mechanism 1*a* and a lower bill conveyance mechanism 1*b*. The upper bill conveyance mechanism 1*a* includes the cash slot 20, bill validator 30, temporary stocker 40 and bill conveyor 50. The bill conveyor 50 passes the bill validator 30 to convey bills between the cash slot 20 on one hand and the storing boxes 60 and 61 through 80 on the other. Each of the deposit box 60, first acceptance box with multi-compartments 61, second acceptance box with multi-compartments 70, recycle boxes 80 and loading/recovering box 81 has a common external shape, a cash slot arranged in a common position and a common drive unit, and is configured to be interchangeable in being fitted to the storing/fitting portion of the bill depositing/dispensing apparatus 1.

A linked conveyance path 501*h* is arranged, in the top face steel plate portion of a safe case 104 surrounding the lower bill conveyance mechanism 1*b*, in a slit cut in a position where the conveyance path 501*g* of the upper bill conveyance mechanism 1*a* and the conveyance path 901*a* of the lower bill conveyance mechanism 1*b* are linked to each other. The slit cut in the top face steel plate portion has a sufficient length to allow the bills to pass and a width equal to that of conveyance rollers fitted to hold and feed the bills conveyed into this slit. In a configuration in which the lower bill handling mechanism 1*b* is not surrounded by the safe case, if the upper bill conveyance mechanism 1*a* is directly mounted on the lower bill handling mechanism 1*b*, the slit will not be absolutely necessary. Motors to drive the conveyance path 50 may be provided separately for the conveyance path of the upper bill conveyance mechanism and the conveyance path of the lower bill conveyance mechanism, or a single drive power unit may be provided to have the driving force transmitted by gears arranged between the conveyance paths 501*g* to 501*h* to 901*a*.

Also, the bill conveyor 50 passes the bill validator 30 bidirectionally and connects the cash slot 20, temporary stocker 40, deposit box 60, first acceptance box with multi-compartments 61, recycle boxes 80, second acceptance box with multi-compartments 70 and loading/recovering box 81 via the conveyance paths denoted by arrows 501*a* through 501*h* and 901*a* through 901*e*.

Out of the whole bill conveyor 50, five bill conveyors 901*a* through 901*e* in front of the deposit box 60 and the first acceptance box with multi-compartments 61, the recycle boxes 80, and the second acceptance box with multi-compartments 70 and the loading/recovering box 81 in the lower bill handling mechanism 1*b* constitute an openable/closable conveyance path 90 which permits integrated opening or closing. The attendant is enabled to open the openable/closable conveyance path 90 and manipulate the deposit box 60, first acceptance box with multi-compartments 61, recycle boxes 80, the second acceptance box with multi-compartments 70 and loading/recovering box 81. Detailed configurations of the bill conveyors 901*a* through 901*e* will be described individually with reference to FIG. 5 through FIG. 9.

In this embodiment of the invention, only one deposit box 60 is mounted. The deposit box 60, as its detailed configuration shown in FIG. 5 reveals, constitutes a stacking mechanism deposited bill box consisting of a stacking roller 601 driven by a driving unit outside the deposit box via gears, backup rollers 602 and 603 opposite the stacking roller 601, a brush roller 604 which is on the same axis as the backup roller 603, is rotated by a drive power source (not shown) independent of the backup roller and has elastic members arranged radially as illustrated, a lower stacking guide 605 and an upper stacking guide 606. The storing space for bills consists of a stacked bill storing space 617 formed by an upper partition 611, a lower partition 613 and a keep plate 615, and an under-stacking bill storing space 616 formed of the upper partition 611, the lower partition 613, the upper stacking guide 606 and the lower stacking guide 605. Further, an inlet/outlet 632 is provided in a position facing the stacking roller 601.

The bills to be stored in the deposit box 60 are conveyed in the direction of arrow 902*a* from the bill conveyor (arrow 901*a*) as a switch-over gate 903 is switched into the state indicated by 903*b* in the illustrate and, via the inlet/outlet 632, fed into a position between the rotating stacking roller 601 and the backup rollers 602 and 603. The bills fed into the position between the stacking roller 601 and the backup roller 603 comes into contact with the elastic member 604*a* of the stopped brush roller 604, passes while being subjected to frictional resistance force from the lower stacking guide 605 by the elastic deforming force of the elastic member 604*a*, once stop in a position where the force of holding and conveyance by the stacking roller 601 and the backup roller 603 is lost and, by turning the brush roller 604 immediately after that, the bills consecutively conveyed to the under-stacking bill storing space 616 are stacked without interfering with one another.

Next, a drive power source is worked to drive a drive belt 618, and an extruding plate 608 linked to the drive belt 618, an extrusion assistance guide 609, an extrusion fulcrum shaft 610 and the upper stacking guide 606 shift in the directions of arrows 621 and 622 to the positions represented by dotted lines 608*a*, 609*a*, 610*a* and 606*a* in the illustration; at the same time, as the upper partition 611 and an upper partition fulcrum shaft 612 linked to the drive belt 618 shift in the direction of arrow 625 in the sequence of dotted lines 611*a* and 612*a* through 611*b* and 612*b* through 611*c* and 612*b* in the illustration, the bills stacked in the under-stacking bill storing space 616 are joined with the bills in the stacked bill storing space 617 to press the keep plate 615 in the direction of arrow 624 and the lower stacking guide 613 in the direction of arrow 623.

Then, the drive belt 618 is driven in the reverse direction to return the extruding plate 608, extrusion assistance guide 609, extrusion fulcrum shaft 610, upper stacking guide 606, upper partition 611 and upper partition fulcrum shaft 612 to their respective initial positions, empty the under-stacking bill storing space 616 and thereby make possible the next round of stacking operation.

In this embodiment of the invention, three recycle boxes 80 are mounted. As their configuration shown in FIG. 6 reveals, the recycle boxes 80 are storing boxes capable of storing and separate feeding of bills. A stack feed roller 801, a pickup roller 811, a rotating backup roller 802, a gate roller 803 which rotates in the stacking direction but does not rotate in the feeding direction, a brush roller 804 which is on the same axis as the gate roller 803 and has elastic members arranged radially, and a separating/stacking guide 805 which operates in separation and in stacking constitute the stacking/separating mechanism. Bills are stored in a storing space surrounded by a bottom plate 808, a keep plate 806, a flat bottom belt 807 so hung as to support the under face of the bills on a plane higher than the bottom plate 808, and the separating/stacking guide 805. There further are a rotating upper scrape-out roller 812 having a saw tooth-shaped outer circumference in the vicinity of the separating/stacking guide 805 in the upper part of the storing space and a rotating lower scrape-out roller 809 having a saw tooth-shaped outer circumference in the vicinity of the gate roller 803 in the lower part of the storing space. Their saw tooth-shaped outer circumferences support the upper and lower ends of stacked bills, and keep the bills erect while scraping them out toward the keep plate 806. Each recycle box has an inlet/outlet 822 in a position facing the stack feed roller 801.

In the operation to separate bills, the separating/stacking guide 805 moves to the position represented by broken line 805*a*, the keep plate 806 and the bottom belt 807 together move within the storing space, and a spring (not shown) move causes fed bills to so move stored bills as to apply a prescribed pressure on the pickup roller 811. The bills pressed against the pickup roller 811 are fed out by the rotating stack feed roller 801 and, while double-sheet feeding is prevented with the gate roller 803 which does not rotate in the feeding direction, are conveyed one by one in the direction of arrow 902*b* via the inlet/outlet 822. The switch-over gate 903 of the bill conveyor is switched over to the direction denoted by 903*b* in the illustration, and the bills are conveyed in the direction of arrow 901*b*.

In the operation to stack bills, the separating/stacking guide 805 moves to the position represented by a solid line, the keep plate 806 and the bottom belt 807 are together moved within the storing space by a drive power source (not shown) outside the safe, and the movement of stored bills is controlled in the direction away from the separating/stacking guide 805 so that incoming bills conveyed in the direction of arrow 902*b* and stored bills may not interfere with each other along with an increase in stored bills. In this process, the upper scrape-out roller 812 turns counterclockwise while the lower scrape-out roller 809 turns clockwise, and the saw tooth-shaped outer circumferences support the upper and lower ends of stacked bills to keep the bills erect while scraping them out toward the keep plate 806.

The loading/recovering box 81 has the same configuration as the recycle boxes 80 and, though it is not used for depositing/dispensing transactions as will be described afterwards, may be operated as a recycle box.

Figure 7:
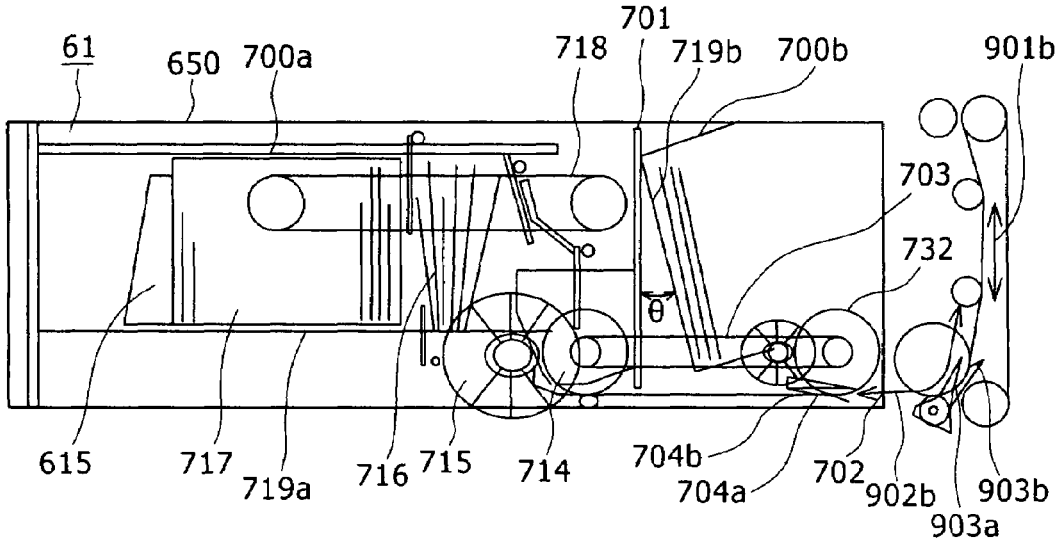
FIG. 7 is a profile showing a first acceptance box with multi-compartments.

FIG. 7 shows an example of configuration of the first acceptance box with multi-compartments 61. The first acceptance box with multi-compartments 61 is a storing box having two independent storages including a storage 700*a* having the same configuration as the deposit box 60 and a storage 700*b* consisting of a simple throw-in type stacking mechanism. The two storages 700*a* and 700*b* are separated from each other by a partition 701 into front and rear compartments of the storing box. Incidentally, this partition 701 may be dispensed with. A bill let in through an inlet/outlet 702 is conveyed to the storage 700*a* when the switch-over gate is switched over to the direction of 704*a* or to the storage 700*b* when it is switched over to the direction of 704*b*. The storage 700*a* (second storage) is provided at its inlet with a stacking roller 714 and a backup roller 715 and, as in the case of the deposit box 60, bills stacked in an under-stacking bill storing space 716 are joined with bills in a stacked bills storing space 717 by driving a drive belt 718, with the keep plate 615 being pressed in leftward in the drawing. The storage 700*b* (first storage) is a simple throw-in type stacking mechanism, into which bills are thrown in from underneath. In addition, the first acceptance box with multi-compartments 61 is provided with a top lid 650 for the convenience of taking out bills from the storages and of maintenance work.

The inlet/outlet 702 disposed facing a stacking roller 732 of the first acceptance box with multi-compartments 61 is a common slot/outlet for the two storages 700*a* and 700*b*. The drive units of the storages 700*a* and 700*b* are linked by a belt 703, and both are driven by a gear 730 as the drive power source. The storage 700*b* closer to the inlet is higher than the storage 700*a* located deeper inside.

Where two storages are to be provided, because of the need to secure a space for arranging a conveyance path to each storage, the storage 700*a* located deeper inside allows a greater storing space to be provided than the storage 700*b* closer to the front. For this reason, the second storage 700*a* deeper inside is used for storing the kind of bills handled in a greater number, and the first storage 700*b*, for storing the kind of bills handled in a smaller number.

The storage 700*a* located deeper inside is a horizontal storage having a horizontal bottom 719*a*. There are belts above and underneath the storage 700*a*, and upper and lower rollers are driven to press the bills in. On the other hand, the storage 700*b* whose space is smaller has a substantially U-shaped section having a bottom 719*b* inclined backward by θ from the perpendicular, and stores bills, which are put in sideways from the lower part, along the inclined bottom. This configuration of the storage 700*b* enables the lower ends of bills to be securely captured with sheet rollers and the bills to be stacked because, even where bills differing in size are to be stacked, the lower ends of the bills are aligned by gravity.

As described above, the storage 700*b* is inclined somewhat upward as viewed from the input side. Thus, the bottom 719*b* of the storage 700*b* is arranged with a backward inclination. This is intended to restrain forward falling of the inputted bills while using a configuration which requires the bills only to be simply thrown in. If the inclination angle θ of the bottom 719*b* relative to the perpendicular is too small, the bills will be more susceptible to forward falling, or if the angle is too small, the space for the storage 700*b* will become correspondingly larger, which means a drop in storing efficiency. The preferable range of the inclination angle θ is from 10 degrees to 30 degrees.

Figure 8:
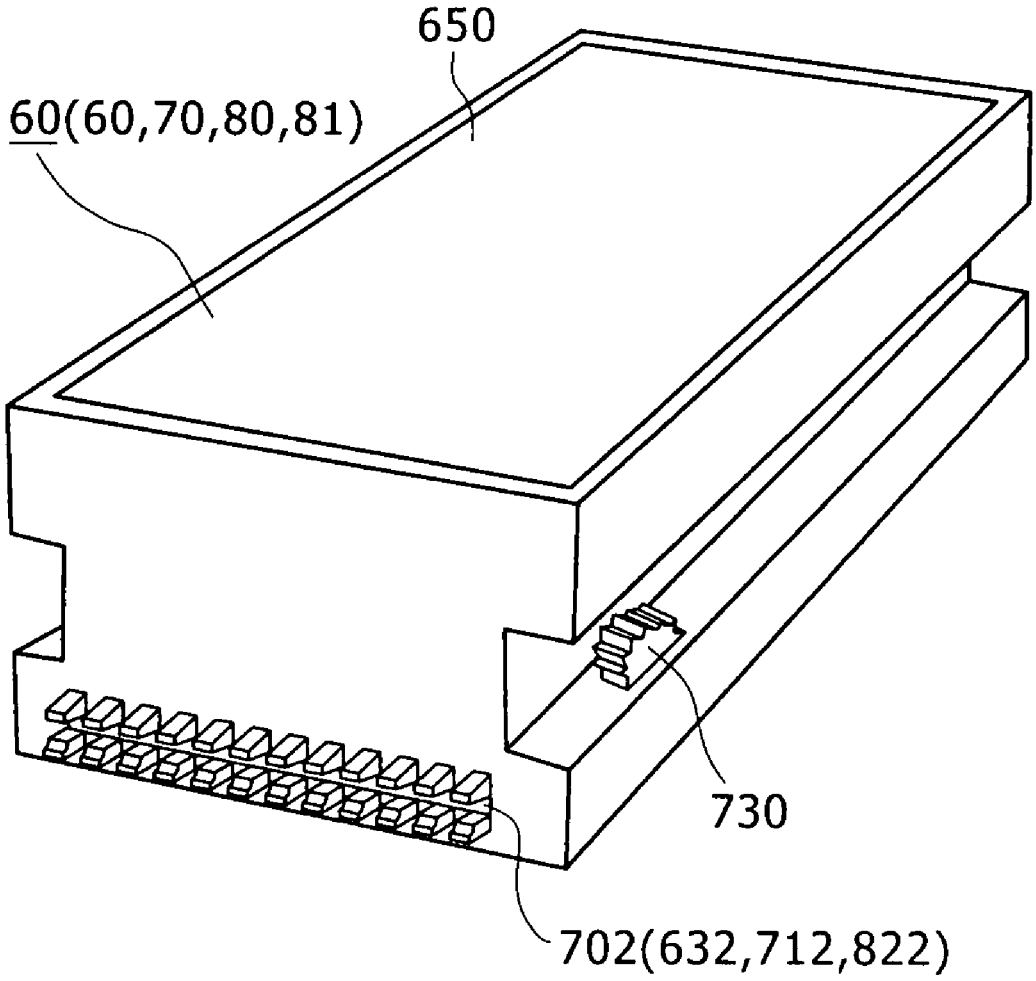
FIG. 8 is an external perspective view showing of a typical storing box.

As shown in the external perspective view of FIG. 8, each of the storing boxes including the first acceptance box with multi-compartments 61, deposit box 60, second acceptance box with multi-compartments 70, recycle boxes 80 and loading/recovering box 81 is a prismatic case having a common external shape, a cash slots (702 or else) arranged in a common position and a common drive unit 730, and is configured to be interchangeable in being fitted. Thus, every one of these storing boxes has a common shape and has one common slot/outlet arranged at the same height. The conveyance drive unit of every storing box is so configured that the stacking roller 601 and the stack feed roller 801 arranged facing the common slot/outlet be driven via the gear 730 driven by an external drive power source. Further, the lid 650 may be disposed as required for the convenience of taking out bills in the storage from other or some other reason.

Figure 9:
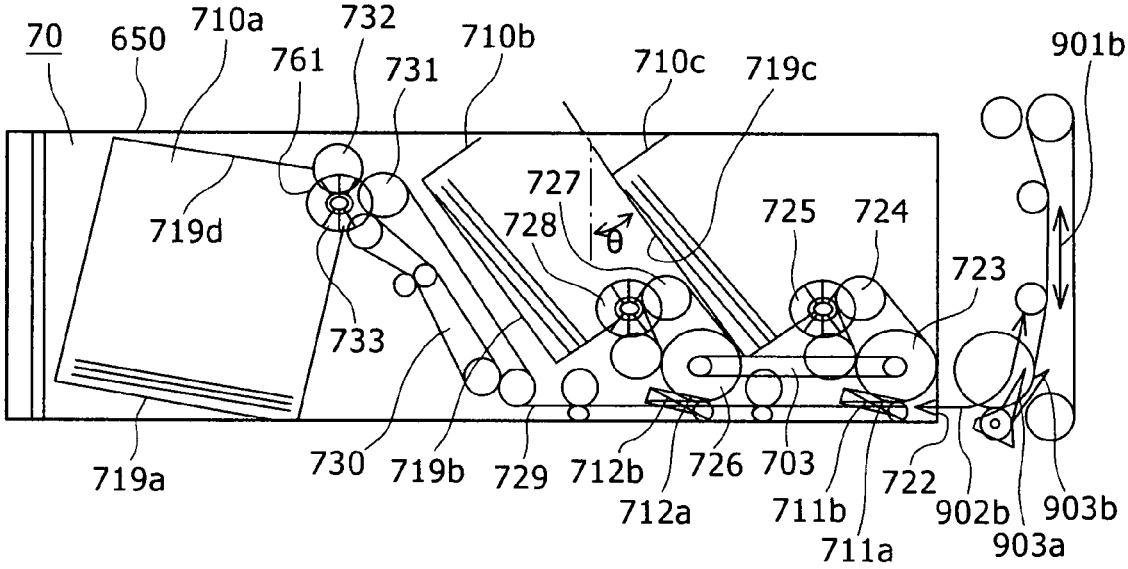
FIG. 9 is a profile showing a second acceptance box with multi-compartments.

FIG. 9 shows an example of configuration of the second acceptance box with multi-compartments 70. The second acceptance box with multi-compartments 70 is a storing box having three independent storages 710*a*, 710*b* and 710*c* each consisting of a simple throw-in type stacking mechanism. The storage 710*a* (second storage) located deepest in the storing box is in a box shape having the bottom 719*a* and an internal lid 719*d*, and has a configuration into which bills are to be thrown in through an opening 761 in the upper right corner. The whole storage 710*a* is slightly inclined forward. On the other hand, both the first storage, namely the storage 710*b* positioned in the central part of the storing box and the storage 710*c* positioned closest to the inlet/outlet have substantially U-shaped sections with the bottoms 719*b* and 719*c* inclined backward by θ from the perpendicular, and have a configuration to accept bills thrown in sideways from the lower part.

The storage 710*a* positioned deepest in the storing box may have a larger storing space because no conveyance path is needed underneath the storage. Therefore it is advisable to use the deepest second storage 710*a* for storing the kind of bills handled in a greater number, and the first storages 710*b* and 710*c*, for storing the kind of bills handled in a smaller number. In the storage 710*a*, for instance, non-recycled denominations of bills circulating in a relatively large number and unsuitable for recycling, such as 5 EURO and 500 EURO bills, and rejected bills are stored. On the other hand, retracted bills and bills rejected for dispensing, whose numbers are smaller, are stored in the storage 710*b* or 710*c*. This differentiated use of the first storages and the second storage makes it possible to achieve a higher overall efficiency of sorted management of bills.

An inlet/outlet 722 disposed facing a stack feed roller 723 is a common slot/outlet for the three independent storages. Bills conveyed in through the inlet/outlet 722 are further conveyed to the storage 710*c* when the first switch-over gate is switched over to the direction of 711*b*, or in the direction of the second switch-over gate when the first switch-over gate is switched over to the direction of 711*a*. When the second switch-over gate is switched over to the direction of 712*b*, the bills are conveyed to the storage 710*b* or when the gate is switched over to the direction of 712*a*, the bills are conveyed to the storage 710*a*.

The bills conveyed to the storage 710*c* are thrown into the storage 710*c* by a stacking roller 724 and a backup roller 725 at the inlet. The bills conveyed to the storage 710*b* as the second switch-over gate is switched over to the direction of 712*b* are thrown into the storage 710*b* by a stacking roller 727 and a backup roller 728 at the inlet. The bills conveyed by a belt 730 as the gate is switched over to the direction of 712*a* are thrown into the storage 710*a* by stacking rollers 731 and 732 and a backup roller 733 at the inlet.

The bottoms 719*b* and 719*c* of the storages 710*b* and 710*c* are inclined somewhat upward as viewed from the input side. Thus they are inclined backward by θ=10 degrees to 30 degrees relative to the perpendicular. By arranging the first storages inclined obliquely backward, the bills may be prevented from falling forward. While in a horizontal storage system as in a conventional recycle box, belts are disposed above and underneath the storing box and bills are pressed by driving upper and lower rollers, their forward falling may be prevented by inclining the storage. Therefore, the storages 710*b* and 710*c* makes it possible to dispense with the upper belt and simplify the structure correspondingly. This enables plural storages to be disposed in a single storing box.

Features of each of the storing boxes described above including the deposit box 60, first acceptance box with multi-compartments 61, second acceptance box with multi-compartments 70, recycle boxes 80 and loading/recovering box 81 will be described below.

The deposit box 60, capable of storing bills of many different denominations, is used for denominations of bills not to be recycled and bills rejected at the time of depositing or dispensing.

The recycle boxes 80, unlike the deposited bill box, may accept only one denomination of bills, but allows both depositing and dispensing of bills.

The loading/recovering box 81 is used when loading the recycle box with bills and recovering bills from the recycle box.

The first acceptance box with multi-compartments 61, capable of storing bills of many different denominations like the two deposit boxes 60, are used for denominations of bills not to be recycled and bills rejected at the time of depositing or dispensing. Unlike the deposit box 60, it has two independent storages, which enables separate storing of denominations of bills not to be recycled and bills rejected at the time of depositing or dispensing, and therefore serves to save the trouble of sorting deposited bills and correspondingly enhance the operational efficiency of the attendants.

Figure 12:
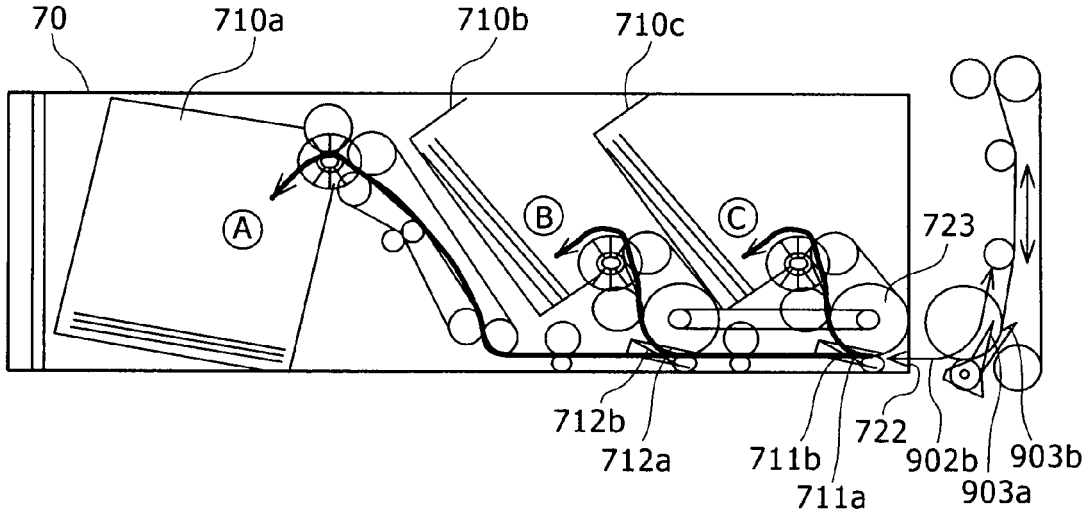
FIG. 12 shows the conveyance path of the second acceptance box with multi-compartments.

The second acceptance box with multi-compartments 70, as shown in FIG. 12, has three conveyance routes (A, B and C) permitting bills coming in through the common slot/outlet 722 to be individually convened to one or another of the three independent storages 701*a*, 701*b* and 701*c* under the control of the switch-over gates 711*a*, 711*b*, 712*a* and 712*b*. This, as does the first acceptance box with multi-compartments 61 described above, enables many different denominations of bills to be handled and bills intended for separation to be stored separately in three areas. When there are bills, though they are not many and their occurrence is relatively rare, to be stored differentiated from others, such as bills to be retracted, it is effective to use these storages. Depending on intended applications, four or five independent storages may be provided as well.

Incidentally, the number of storages to be arranged in each acceptance box with multi-compartments to handle many denominations of bills should preferably be three to five. The reason will be explained. First, there are currently plural kinds of bills to be stored in a differentiated way, including left-behind withdrawn bills, rejected ones of deposited bills, rejected bills to be dispensed otherwise, broken bills, counterfeit bills and bills not to be definitely validated. It is conceivable to increase the number of storages so that all of them may be stored in a differentiated way in a single acceptance box with multi-compartments. However, any storage using a simple throw-in type stacking mechanism should be inclined by 10 degrees to 30 degrees to prevent the stored bills from falling forward, and this structural feature will be lost if the number of storages is increased. A large number of storages would also entail such disadvantages as complexity of conveyance routing or the need for a large installation area. Conversely, if the number of storages is too small, the space efficiency will deteriorate for bills of relatively little handled denominations and, if there is a wide variety of bills to be stored in a differentiated way, the number of storing boxes needed for accepting all those kinds of bills will become too large. With all these factors taken into account, the advisable number of storages would be three to five.

These storing boxes including the deposit box 60, first acceptance box with multi-compartments 61, second acceptance box with multi-compartments 70, recycle boxes 80 and loading/recovering box 81 differ from one another in the purpose of use, but they are the same in external shape, inlet/outlet and driving unit, and various operational modes each fitting a particular purpose may be readily realized by combining them in appropriate ways.

Examples of configuration and operation of the bill depositing/dispensing apparatus according to the invention combining these storing boxes will be described below.

Load Operation:

First will be described the operation to load bills. Referring back to FIG. 1, in the load operation, the attendant collectively sets bills in the loading/recovering box 81 and loads the box at the lowest level of the bill depositing/dispensing apparatus 1 instead of individually setting bills in the recycle boxes 80 differentiated by denomination.

As a result of this setting, the bills are automatically conveyed by the bill conveyor 50 in the bill depositing/dispensing apparatus, and stored into the recycle boxes 80. First in a load count operation, bills fed out of the loading/recovering box 81 undergo identification of the denomination by the bill validator 30 via the bill conveyor 50 (901*d* through 901*a*, 501*h*, 501*g* and 501*b*) and, as the switch-over gate 503 is switched over, are once stored into the temporary stocker 40.

Load Store Operation:

Next in the load store operation, bills are successively discharged from the temporary stocker 40, pass the same bill conveyor 50 in the reverse direction, and stored one or another of the recycle boxes 80 designated for each denomination. When the number of bills collectively set in the loading/recovering box 81 is greater than the capacity of the temporary stocker 40, the load count operation and the load store operation are repeated. Bills rejected for loading in the load count operation, whose denomination failed to be identified, are stored into the cash slot 20 via 501F with the switch-over gate 503 being switched over to the direction of 503*b* in the illustration. After the operation to store all the bills to be loaded is completed, bills stored into the cash slot 20 are stored as rejected bills into the deposit box 60. It has to be noted, though, that another empty deposit box 60 or acceptance box with multi-compartments 61 is made ready for use in actual management, the deposit box 60 storing the rejected bills is replaced by this extra box. Since the loading/recovering box 81 here is unnecessary after the end of loading, it is detached and replaced by the second acceptance box with multi-compartments 70.

Recover Operation:

A recover operation is an operation to automatically recover from the recycle boxes 80 a prescribed number of bills and stored them into the loading/recovering box 81 when the recycle boxes 80 have become full, instead of having the attendant individually take out bills from one or another of the recycle boxes. In the recover operation, the bills travel in the reverse routing to that of the load operation.

In the recover operation, the second acceptance box with multi-compartments 70 is replaced by the loading/recovering box 81, which is mounted on the bill depositing/dispensing apparatus, and bills are once stored into the temporary stocker 40 from the recycle boxes 80 and then recovered into the loading/recovering box 81 from the temporary stocker 40. Bills rejected in the recover count operation or recover store operation on account of failure to identify the denomination or any other reason are stored into the deposit box 60 in the recover store operation, with the switch-over gate 903 being switched over to the direction of 903*b*. Detailed description of this process is dispensed with. After the completion of recovery, the loading/recovering box 81 is unnecessary and therefore replaced by the second acceptance box with multi-compartments 70.

Cash Count Operation:

During a cash count operation from the time the user deposits bills and they are stored into the temporary stocker 40, the bills put into the cash slot 20 are separated one by one, and each bill passes in the directions of arrows 501*a* and 501*b* to be conveyed to the bill validator 30, where the denomination and validity of the bill are determined. The bills having passed the determination are carried in the directions of arrows 501*c* to 501*d*, with the switch-over gate 503 being switched over to 503*a*, to be once stored into the temporary stocker 40. Bills rejected for deposit, including bills having failed to be identified by the bill validator 30 and bills found abnormal in inclination or in space between each other are not stored into the temporary stocker 40, but pass in the direction of arrow 501*f*, with the switch-over gate 503 being switched over to 503*b*, to be stored into the cash slot 20 and returned to the user.

Store Money Operation:

In a store money operation by which bills stored into the temporary stocker are to be stored into the deposited bill box, recycle boxes, first acceptance box with multi-compartments and second acceptance box with multi-compartments, the rotary drum 401 of the temporary stocker 40 is turned in the reverse direction to the direction at the time of storing into the temporary stocker 40, the bills taken up by the drum are in the direction of arrow 501*d*, in the reverse sequence and in the reverse direction to 501*c* and 501*b*, passes the bill validator 30 and, with the switch-over gate 502 being switched over to the direction of 502*b* in the illustration, stored into a designated one of the deposit box 60 and the recycle boxes 80 via 501*g*, 501*h* and 901*a*, with the switch-over gate 903 of that designated storing box being switched over to the direction of 903*b* in the illustration. The denomination, validity and so forth of each may again be determined then by the bill validator 30 and the storing box designated on that basis, or means to store the result of determination of every bill when it is to be stored into the temporary stocker 40 at the time of cash count may as well be provided and the storing box designated on the basis of that stored information.

If the first acceptance box with multi-compartments 61 is used here in place of the deposit box 60, rejected bills in a deteriorated state unfit for recycling may be stored into the storage 700*b*, and bills of any non-recycled denomination in a satisfactory state differentiated and stored into the storage 700*a*. This would facilitate management of the bills.

Withdrawal Processing Operation:

When a withdrawal is to be processed, a prescribed number of bills is fed out of the safe for each denomination in the recycle boxes 80, undergo determination of the denomination by the bill validator 30 after traveling in the directions of arrows 901*e*, 901*d*, 901*c*, 901*b*, 901*a*, 501*h* and 501*g*, branched by the switch-over gate 503 and stored into the cash slot 20 to be paid to the user. Any bill to be otherwise dispensed is rejected on account of failure to be identified by the bill validator 30 is once stored into the temporary stocker 40, as at the time of cash count, with the switch-over gate 503 being switched over to 503*b* in the illustration. The resultant shortage of any bill is filled by additional feeding from the recycle boxes 80.

Bill Rejected For Withdrawal Store Operation:

When any bill is rejected for withdrawal by the user and stored into the temporary stocker 40, a bill rejected for withdrawal store operation is performed. Any bill rejected for withdrawal is stored into the deposit box 60 from the temporary stocker 40. Or, if it is desired to sort bills rejected for deposit and bills rejected for withdrawal, the two kinds of rejected bills may be managed separately from each other by storing bills rejected for withdrawal into the second acceptance box with multi-compartments 710*a*.

Bill Retracts Operation:

If the user leaves behind bills withdrawn and coming out of the cash slot 20 after a dispensing transaction, they may be left as they are in the cash slot 20 and the transaction suspended by reason of failure of the apparatus, but the left-behind bills, after temporarily holding them in the cash slot, may be separated from the cash slot 20, undergo validation as in a deposit transaction, and stored into the second acceptance box with multi-compartments 710*b* differentiated from bills rejected for withdrawal. In the same way, a second set of left-behind withdrawn bills may be stored into 710*c*. Other transactions are enabled to be continued by storing left-behind bills, after temporarily holding them in the cash slot, into the second acceptance box with multi-compartments.

Sorted Store Operation 1:

In order to save the trouble of carrying an empty deposit box 60 which is to be required for storing bills rejected at the time of loading, the first acceptance box with multi-compartments 61 and the second acceptance box with multi-compartments 70 may be utilized by storing bills rejected at the time of loading into 700*b* of the first acceptance box with multi-compartments 61 and bills rejected for deposit and bills not to be recycled into 700*a* of the same.

Sorted Store Operation 2:

When there are two denominations bills of which are not to be recycled when deposited, 700*a* and 700*b* of the first acceptance box with multi-compartments 61 may be used as storing boxes for the denominations not to be recycled, 710*a* of the same as that for bills rejected for deposit and bills rejected for withdrawal, and 710*b* and 710*c* of the second acceptance box with multi-compartments for retracted left-behind bills.

Figure 10:
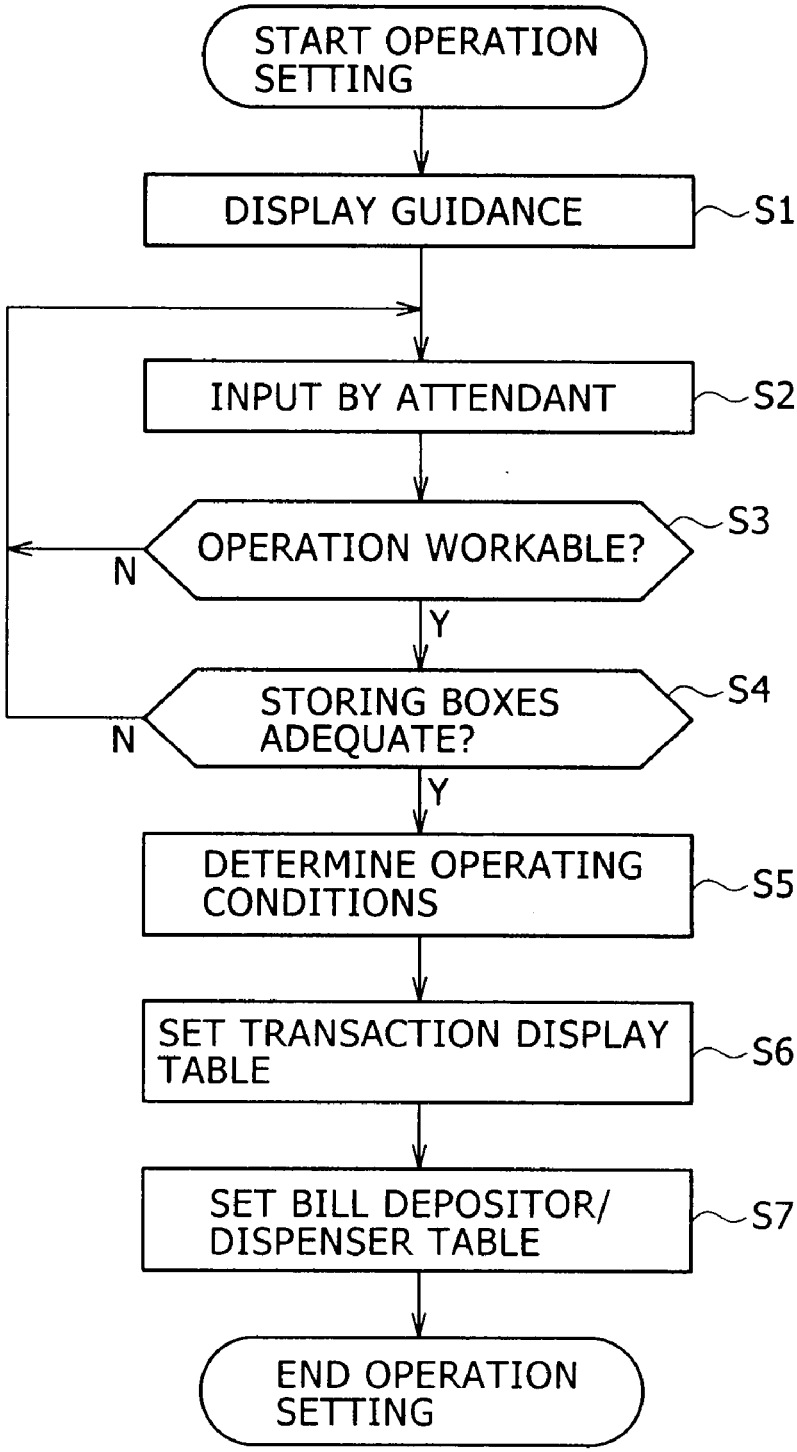
FIG. 10 is a flowchart of setting of the procedure of operation.

Next will be described in more specific terms the method of setting of the procedure of operating an automated teller machine using the bill depositing/dispensing mechanism, which is this embodiment of the invention. FIG. 10 is a flowchart of setting of the procedure of operation. The setting of the procedure of operating of the automated teller machine 101, according to FIG. 1, is accomplished by an attendant who performs inputting through the attendant-operable unit 106*c*. When the setting of the operating procedure is started, first a guidance display (step S1) is outputted.

The attendant inputs by selective inputting with keys or otherwise to each of the mounted storing boxes, for instance, box types, such as the deposited bill box, first acceptance box with multi-compartments, recycle box, second acceptance box with multi-compartments and loading/recovering box and the denominations of bills (step S2).

Next, on the basis of the results of the inputs above, it is determined whether or not preset constraints stored in the controller 35 or the main controller 106 are met: for instance whether a recycle box is set in its prescribed position (e.g. the leading storing box 1), whether the required number of storing boxes has been set, or whether the variety of denominations of bills sufficient for the management of the system (step S3). Then, on the basis of information from a sensor for the presence or absence of a storing box, a sensor for determination the type of the storing box and a sensor for detecting the remaining number of bills in the storing box, whether or not these set conditions are met and the presence or absence of actually set storing box, identity and remaining content are determined (step S4).

If the result of this determination indicates operability, the conditions of operation are determined (step S5) or, if inoperable, the attendant will perform the inputting again (step S2). The sensor for determination the type of the storing box is so configured that the type and bill denomination of the storing box is set for, or a memory unit is fitted to each storing box, and these items of information is detected or read out. It is also possible to automatically make decision according to detection or reading by the storing box type determining sensor and to dispense with inputting by the attendant.

Once the conditions of operation are determined, a table having display columns indicating ¥ deposited, ¥ dispensed, $ deposited, $ dispensed and so forth together with transactions executable according the conditions of operation is set on the transaction display 107 (step S6). Further, the determined set conditions are reported as table information to the controller 35 of the bill depositing/dispensing mechanism 1 (step S7) to complete operation setting.

Incidentally, when setting is to altered by the attendant, usually the number of set conditions is usually limited to a few, and therefore the operating ease may be improved by tabulating the items into such as operating modes 1, 2, 3 and 4 and having the attendant choose the applicable one or ones out of them. For instance, operating modes 1 and 2 might be offered as options for an apparatus handling Japanese yen and U.S. dollars in a domestic financial institution of Japan, and modes 3 and 4, for an apparatus handling Singaporean bills which have many different denominations.

The configuration described above makes possible choice and combination, as desired according to the environment of use, of storing boxes including the deposited bill box, first acceptance box with multi-compartments, second acceptance box with multi-compartments, recycle box, and loading/recovering box. It also enables the number of denominations, depositing function alone, dispensing function alone, depositing/dispensing function, recycle function, loading/recovering function and other sophisticated functions to be selected. Where the attendant is to alter the setting during operation, there is a risk of wrong manipulation because the storing boxes are interchangeable, but this risk may be hedged. It is done by providing each storing box and a storing/fitting unit to which the storing box is to be fitted with a discriminating/detecting mechanism (discriminator and detector) to display and stored the distinction of safe, that of denomination, the number of bills stored and so forth, and having the controller 35 detect or read these items of information on storing boxes to manage them. In this way, the handling ease may be improved, wrong attachment or detachment prevented, and cash management made more strict. Such a discriminating/detecting mechanism may be realized by fitting to a prescribed area in each storing box an IC chip (discriminator) in which a memory to store the distinction of safe, that of denomination, the number of bills stored and so forth and an antenna for short-range communication are embedded, and fitting the storing/fitting unit with an IC chip for transmission/reception (detector) capable of communicating with that discriminator IC chip. Furthermore, since the acceptance box with multi-compartments has three or more independent storages permitting sorted storing, space-efficient storages which may handle bills left behind by any user without mixing them up with other cash in the apparatus, enabling other transactions to be continued even when any user leaves behind withdrawn bills.

Since this embodiment of the invention allows every storing box to be fitted interchangeably, the form of operation may be easily altered by merely replacing a pertinent storing box or boxes and setting control conditions accordingly.

To consider a case of handling EURO bills for instance, at present there are seven different denominations. FIG. 11 shows an example of handling EURO bills. When there are many dispensing transactions and loading of many recyclable bills is desired, four recycle boxes may be mounted as shown in column (a) of FIG. 11. In this case, a great number of bills of four denominations at the maximum may be recycled. Further, where bills rejected for depositing and/or bills rejected for dispensing are to be sorted, the first acceptance box with multi-compartments 61 or the second acceptance box with multi-compartments 70 may be mounted in place of the deposit box 60.

If there are many depositing transactions, the number of tiers of deposited bill boxes may be increased as shown in column (b) of FIG. 11. This configuration, too, may be readily realized merely by replacing two recycle boxes in the configuration of column (a) of FIG. 11 with deposited bill boxes. In this case again, if bills rejected for depositing and/or bills rejected for dispensing are to be sorted, the first acceptance box with multi-compartments 61 or the second acceptance box with multi-compartments 70 may be mounted in place of the deposit box 60.

Where the number of deposited/dispensed bills is not so great and bills rejected for depositing/dispensing and bills unfit for recycling, such as broken bills and apparently counterfeit bills, are to be sorted for management, or left-behind bills are to be sorted for management, the configuration of column (c) of FIG. 11 may be used. In this case, the first acceptance box with multi-compartments 61 or the second acceptance box with multi-compartments 70 in place of the deposited bill box of the recycle box. As four to six independent storages are secured at the top two tiers in the configuration of column (c) of FIG. 11, each storage may be easily adapted to diverse uses, thereby to make the bill depositing/dispensing apparatus convenient to use.

Figure 13:
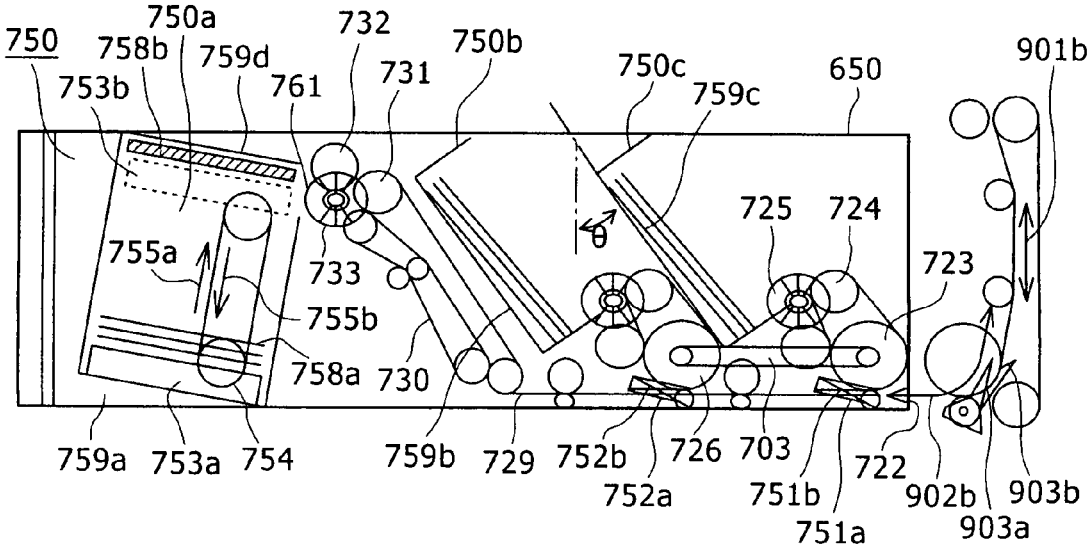
FIG. 13 is a profile showing an acceptance box with multi-compartments in another embodiment of the invention.

FIG. 13 shows an example of configuration of an acceptance box with multi-compartments 750 in another embodiment of the invention. This acceptance box with multi-compartments 750, which is a variation of the second acceptance box with multi-compartments 70, is a storing box having a storage 750*a* (second storage) of a vertical storing system, positioned deepest inside, and two independent storages 750*b* and 750*c* (first storages) consisting of simple throw-in type stacking mechanisms. The box-shaped storage 750*a* having a bottom 759*a* and an internal lid 759*d* uses a vertical storing system, and has a configuration into which bills are to be pressed in through the opening 761 in the upper right corner and compressed by a keep plate 753*a* and its drive unit 754. The storage 750*a* has an overall shape of which the upper side is slightly inclined forward. On the other hand, both first storages, namely the storage 750*b* positioned in the central part of the storing box and the storage 750*c* positioned closest to the inlet/outlet, have bottoms 759 and 759*c* having a substantial U shape, inclined by θ from the perpendicular. Their configuration is such that bills are thrown in sideways from the lower part. A lid 650 matching the storages is provided as required.

The storage 750*a* positioned deepest inside the storing box, since there is no need to lay a conveyance path underneath it, may be enlarged in size. Therefore, the deepest second storage 750*a* is used for storing the kind of bills handled in a greater number, and the storages 750*b* and 750*c* closer to the front, for storing the kind of bills handled in a smaller number.

The inlet/outlet 722 disposed facing the stack feed roller 723 is a common slot/outlet for the three independent storages. Bills conveyed in through the inlet/outlet 722 are further conveyed to the storage 750*c* when the first switch-over gate is switched over to the direction of 751*b*, or in the direction of the second switch-over gate when the first switch-over gate is switched over to the direction of 751*a*. When the second switch-over gate is switched over to the direction of 752*b*, the bills are conveyed to the storage 750*b* or when the gate is switched over to the direction of 752*a*, the bills are conveyed by the belt 730 and thrown into the storage 750*a* by the stacking rollers 731 and 732 and the backup roller 733 in the inlet part. The storage 750*a* is provided with a drivable push plate 753*a*. When to store bills, the drivable push plate 753*a* is once moved in the direction of compressing the bills and press inward the bills the spaces between which have become tight. Thus, by driving the push plate 753*a* behind bills 758*a* with a drive unit 754 in the direction of arrow 755*a* to the position of a push plate 753*b*, bills 758*b* are compressed toward the internal lid 759*d*. Together with the compressed bills, the push plate 753*a* is returned to its original position 753*a*. By making the spaces between the bills tight in this way, the number of bills accommodable by the storage 750*a* may be increased.

On the other hand, the bottoms 759 and 759*c* of the storage 710*b* and 710*c* are inclined slightly upward as viewed from the conveying side. In other words, they are inclined backward by θ=10 degrees to 30 degrees relative to the perpendicular. By arranging the first storages inclined obliquely backward, the bills may be prevented from falling forward. For this reason, it is made possible to provide three to five storages in a single acceptance box with multi-compartments. For instance, one acceptance box with multi-compartments may be composed of three to five storages in total, including one storage (second storage) of a vertical storing system or a horizontal storing system for storing bills of which a large number are to be handle and plural simply structured storages (first storages) for storing bills of which a small number are to be handled. It is also conceivable to configure three to five storages, all first storages of the simple structure for bills of which a small number are to be handled.

As hitherto described, by making interchangeable the external shapes, inlet/outlets and drive units of storing boxes differing in the purpose of use, including the deposit box 60, first acceptance box with multi-compartments 61, second acceptance box with multi-compartments 70, recycle boxes 80 and loading/recovering box 81, the apparatus may be operated in many different ways by choosing and combining storing boxes as desired according to the purpose without having to remaking (or buying new) hardware.

Figure 14:
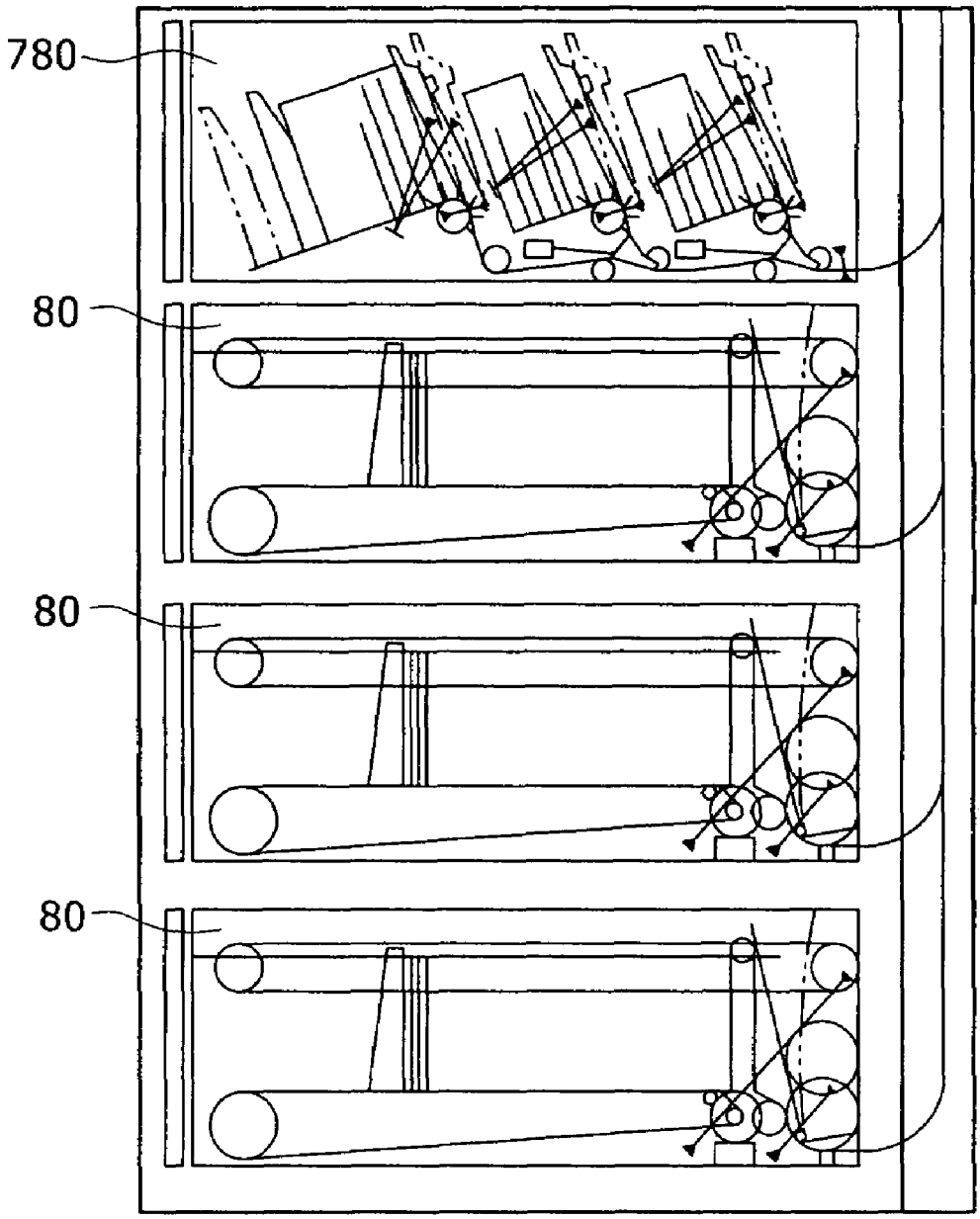
FIG. 14 is a profile showing an example of arrangement of storing boxes in a bill depositing/dispensing mechanism in the other embodiment of the invention.

Now, another embodiment in respect of the arrangement of storing boxes will be described with reference to FIG. 14. FIG. 14 shows the lower bill handling mechanism 1*b* of the bill depositing/dispensing apparatus 1 shown in FIG. 1, but the illustration of the upper bill handling mechanism 1*a* id dispensed. In this example by installing an acceptance box with multi-compartments 780 over the three recycle boxes 80, the jamming of bills may be reduced in frequency. Thus, bills conveyed from the upper bill handling mechanism 1*a* include bills in a poor state, such as creased bills, stuck-together bills and rejectable bills. Generally, the longer the distance of conveying such bills, the more likely their jamming. However, in this example, by installing the acceptance box with multi-compartments 780 in the position doses to the upper bill handling mechanism 1*a*, namely at the top of the storing/fitting unit, it is made possible to reduce the conveyance length of bills and thereby to reduce the occurrence of jamming. As the external dimensions and other aspects of the recycle boxes 80 and the acceptance box with multi-compartments 780 are similarly configured, and depositing, dispensing and other operations are processed in the same way as the foregoing embodiment, their detailed description will be dispensed with.

Figure 15:
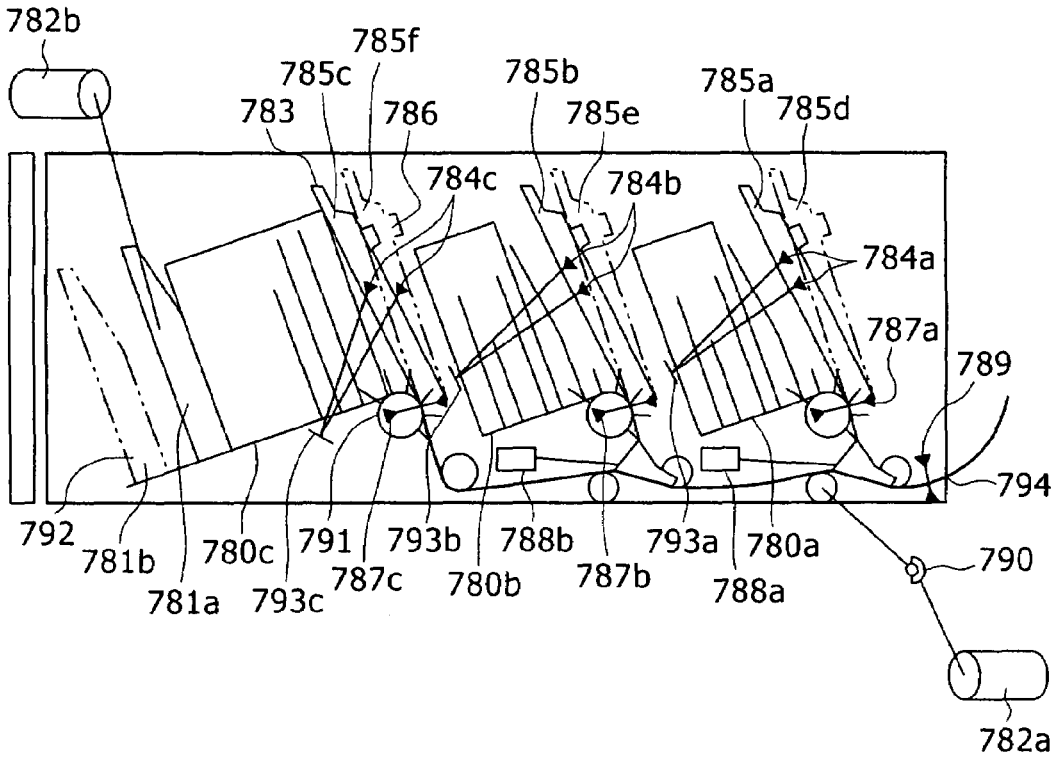
FIG. 15 is a profile showing an acceptance box with multi-compartments in the other embodiment of the invention.

FIG. 15 shows another example of acceptance box with multi-compartments 780 in the storing arrangement shown in FIG. 14. Incidentally, though the illustration of the conveyance path 901 and other elements (as in FIG. 13 for instance) is dispensed with, bills are conveyed from the lower right of this drawing. The acceptance box with multi-compartments 780, though having three storages as does the acceptance box with multi-compartments in the above-described case, all the three storages are equally inclined relative to the perpendicular. Therefore, the storing space may be utilized even more effectively than the examples of FIGS. 12 and 13. Regarding the allocation of bills to these three storages, in a standard way, the storage 780*a* of the acceptance box with multi-compartments 780 closest to the inlet 794 for bills is used for bills rejected for dispensing, the storage 780*b* at the center for suspect counterfeit bills, and the deepest inside storage 780*c* for bills rejected for depositing and bills not to be recycled. It is also possible to so alter the setting as to have the central storage 780*b* to store left-behind bills. The reason why the central storage 780*b* is fit for storing suspected counterfeit bills and left-behind bills is that the circulation of these types of bills by any financial institution is not yet decided to be either permissible or impermissible.

A bill depositing/dispensing apparatus having this acceptance box with multi-compartments 780 may handle EURO bills as well. Since EURO bills have many different denominations as stated above, the three recycle boxes 80 in the example shown in FIG. 14 is unable to accommodate all the denominations of EURO bills, leaving many unrecycled bills for deposit which is unable to store in the recycle boxes 80. For this reason, it is desirable to secure an ample space for these storages to accommodate bills for deposit. In view of this need, it would be efficient to so configure a storage 780*c*, the deepest among storing boxes 780 shown in FIG. 15, as to have a greater bill storing space than the other storage 780*a* or 780*b* and to store bills of unrecycled denominations and bills rejected for depositing in this storage 780*c*.

Underneath the storages 780*a*, 780*b* and 780*c*, sensors 787*a*, 787*b* and 787*c* are respectively arranged, and the passage of bills is checked by the relative brightness of these sensors. These bills are stacked in the respective storages along stacking guides 785*a*, 785*b* and 785*c* which are to stabilize the stacking performance. The stacking guides 785*a*, 785*b* and 785*c* may move the positions of 785*d*, 785*e* and 785*f* (dotted lines in the drawing). The deepest storage 780*c* is provided with a push plate 781*a*, which moves to approach the stacking guide 785*c* so as to compress gaps between the stacked bills. When the stacking guide 785*c* has reached the position of dotted line 785*f*, it may sense with a sensor 786 that they have been pressed. The stacking guides 785*a* and 785*b* may also be enabled to move to the positions of dotted lines 785*d* and 785*e*, respectively. This configuration would be able to help enlarge the bill storing space if only a little and facilitate taking out the bills. The stack of bills is conveyed by a stacking roller at the inlet to each storage, and the end faces of bills are neatly aligned along the bottom plate as illustrated.

The presence or absence of bills in the storages 780*a*, 780*b* and 780*c* may be checked by the relative brightness of the respective sensors 784*a*, 784*b* and 784*c*. If the bill storing space in each storage is extensively utilized, the space underneath each storage will become scarce. Especially under the storages 780*a* and 780*b*, the conveyance path is mounted for bills. In view of this circumstance mirrors 793*a* and 793*b* are arranged near the plate on the side of the storages 780*a* and 780*b* which supports the front or rear faces of bills, and a mirror 793*c* is arranged near the bottom face support the end face of bills in the storage 780*c*. This configuration enables a pair each of sensors 784*a*, 784*b* and 784*c* arranged near the stacking guides to monitor two points.

The bills pass the inlet 794 and enter into the acceptance box with multi-compartments. The number of bills is counted by an inlet sensor 789. Reference signs 788*a* and 788*b* denote solenoids for altering the destinations to the storages 780*a*, 780*b* and 780*c*. By switching on and off the solenoids 788*a* and 788*b*, bills may be allocated to destined storages. When both of the solenoids 788*a* and 788*b* are off, the bills are conveyed to the deepest storage 780*c*; when only the solenoid 788*a* is on, the bills are conveyed to the storage 780*a*; when only the solenoid 788*b* is on, they are conveyed to 780*b*. Reference sign 782*a* denotes a motor for moving the conveyance path, and whether or not the conveyance path is running at the right speed is monitored by a conveyance path monitoring sensor 790.

Figure 16:
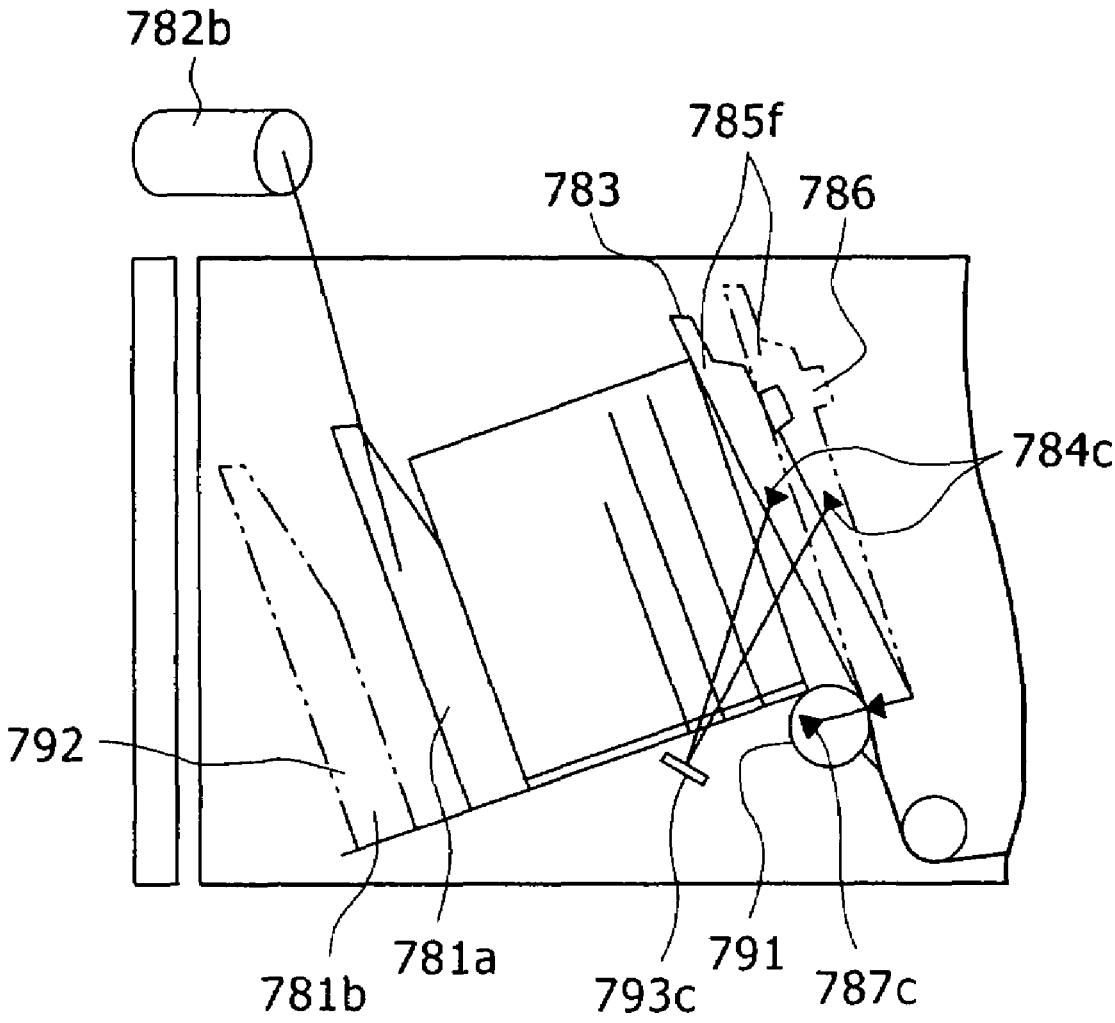
FIG. 16 is a profile showing details of the deep part of the acceptance box with multi-compartments in the other embodiment of the invention.

FIG. 16 shows details of the storage 780*c* of the acceptance box with multi-compartments 780 shown in FIG. 15. The storage 780*c* has a larger storing space than the storage

780*a* or 780*b*. To enable bills to be neatly stored in that large space, the other storages have the following features.

The storage is surrounded by a front plate (stacking guide), a rear plate, a pair of side plates and a bottom plate. Though the configuration to enable bills to be stored therein is similar to that of the other storages, in particular the storage 780*c* has a shiftable keep plate 781*a*, which is equivalent to the rear plate. When bills are to be stored in the storage 780*c*, the keep plate 781*a* is moved in advance by a driving motor 782*b* in preparation for accepting a deposit to thereby secure a space that accommodates about 20 bills. In other words, about 20 bills may be stored in the gap (range) between the keep plate 781*a* and the stacking guide 783 in the longitudinal direction of the drawing. If the gap is too narrow, it will be impossible to stack the bills or, conversely, if it is too wide, earlier stored bills will fall and thereby affect the stacking of bills to be stacked after them. Therefore, it is intended to stabilize the stack of bills and reduce the risk of jamming by keeping a storing space for about 20 bills.

Unrecycled bills and others are successively stored into the storage 780*c* by the stacking roller. Therefore, when a certain number of bills has been stored, the keep plate 781*a* is moved backward (in the direction of sign 781*b*) by the driving motor 782*b* to secure a storing space, and control is so performed as to consecutive store succeeding bills. If the keep plate is moved back too much, the bills will be caused to fall, likely to invite jamming, and therefore it is preferable to enable about 20 bills to be stored. Incidentally, when the bills are to be counted by the bill validator 30, the number of bills to be stored into the storage 780*c* is known in advance. Therefore, it is also possible to lower the keep plate 781*a* in advance according to that number of bills.

However, if the number of bills to be stored increases to 50 to 100, it will become more likely to secure too great a storing space between the stacking guide and the keep plate. In this case, the bills would fall without leaning on the keep plate, and might invite jamming.

For this reason, it is preferable to control the keep plate for about 20 bills at a time as stated above even if the number of bills increases to 50 to 100.

In order to increase the number of bills to be stored in the storage 780*c*, it is preferable, after the stacking of bills is completed, to once cause the keep plate 781*a* to be moved ahead (toward the stacking guides 783) by the driving motor 782*b* and, after compressing the stored bills and thereby narrowing the gaps between them, and so control the keep plate 781*a* to move backward. A sensor 792 to detect a state of being filled with bills is provided in the rearmost position of the storage 780*c*, and it is thereby made possible to detect the state of being filled with bills when the keep plate 781*a* has reached the position of 781*a*.

What is claimed is:

1. A bill depositing/dispensing apparatus to which a plurality of storing boxes for storing bills may be fitted; the bill depositing/dispensing apparatus comprising:

a plurality of storing boxes including a deposited bill box for storing deposited bills, an outgoing bill box for storing bills to be dispensed, a recycle box for storing both deposited bills and bills to be dispensed, and an acceptance box with multi-compartments for sorted storing of bills;

wherein the acceptance box with multi-compartments has a fitting mechanism common to at least one of a fitting mechanism of the deposited bill box, the outgoing bill box and the recycle box;

wherein the acceptance box with multi-compartments has a slot in a same position to at least one of the deposited bill box, the outgoing bill box and the recycle box;

wherein the acceptance box with multi-compartments has a plurality of storages for storing bills conveyed in through a common slot; and wherein the plurality of storages are arranged in a horizontal direction within the acceptance box with multi-compartments, and at least two storages of the plurality of storages are arranged with an inclination in a same direction relative to a bottom surface of the acceptance box.

2. The bill depositing/dispensing apparatus according to 1, wherein the plurality of storages in the acceptance box with multi compartments include three to five independent storages.

3. The bill depositing/dispensing apparatus according to claim 1, further comprising:

a setting function to set the type of transaction and the operation of transactions based on the denomination of bills in accordance with the state of fitting of each of the storing boxes;

wherein the setting function is to set sorted storing of bills withdrawn but left behind by the user, rejected bills determined at the time of depositing to be unfit for recycling, and rejected bills determined before dispensing to be unfit for recycling into one or another of the storages.

4. The bill depositing/dispensing apparatus according to claim 1, wherein the acceptance box with multi-compartments includes a first storage which is inclined upward by 10 degrees to 30 degrees as viewed from a bill conveying side and into which bills are stored sideways from a lower part.

5. The bill depositing/dispensing apparatus according to claim 1, wherein the acceptance box with multi-compartments comprises a first storage so configured that bills are stored sideways from the lower part, a conveyance path disposed underneath the first storage, and a second storage which is arranged deepest inside the acceptance box with multi-compartments and has a greater space than the first storage and into which bills are stored sideways from an upper part.

6. The bill depositing/dispensing apparatus according to claim 1, wherein the acceptance box with multi-compartments comprises a first storage for storing a large number of bills and a second storage having a greater capacity for the storage of bills than the first storage.

7. The bill depositing/dispensing apparatus according to claim 6, wherein the second storage of the acceptance box with multi-compartments has a keep plate to support the surfaces of the bills, and the keep plate is so moved as to keep a prescribed storing space for stacking the bills.

8. The bill depositing/dispensing apparatus according to claim 1, provided with a manipulating unit to be manipulated by the user and a setting function by which the operation of transactions based on the type of transaction and the denomination of bills may be set via the manipulating unit in accordance with the state of fitting of each of the storing boxes.

9. A bill depositing/dispensing apparatus to which a plurality of storing boxes for storing bills may be fitted, the bill depositing/dispensing apparatus comprising:

a plurality of storing boxes including a deposited bill box for storing deposited bills, and outgoing bill box for storing bills to be dispensed, and recycle box for storing both deposited bills and bills to be dispensed, and an acceptance box with multi-compartments for sorted storing of bills;

wherein the acceptance box with multi-compartments has a fitting mechanism common to at least one of a fitting mechanism of the deposited bill box, the outgoing bill box and the recycle box;

wherein the acceptance box with multi-compartments has a slot in a same position to at least one of the deposited bill box, the outgoing bill box and the recycle box;

wherein the acceptance box with multi-compartments has at least a first storage and a second storage into which bills are conveyed and stored through a common slot; and wherein a bottom surface of the first storage and the second storage are arranged within an inclination in a same direction relative to a bottom surface of the acceptance box.

10. The bill depositing/dispensing apparatus according to claim 9, wherein the second storage of acceptance box with multi-compartments stores unrecycled bills not to be stored in the recycle box.

11. The bill depositing/dispensing apparatus according to claim 9, wherein a stacking guide is provided on a face opposite the keep plate, and the keep plate is so driven as to move toward the stacking guide when the stacking of bills has been completed.

12. The bill depositing/dispensing apparatus according to claim 9, wherein the first storage and the second storage store bills in a longitudinal direction.

13. The bill depositing/dispensing apparatus according to claim 9, wherein the first storage and second storage are arranged with an inclination in the same direction relative to the perpendicular.

14. A bill depositing/dispensing apparatus to which a plurality of storing boxes for storing bills may be fitted, the bill depositing/dispensing apparatus comprising:

a plurality of storing boxes including a deposited bill box for storing deposited bills, an outgoing bill box for storing bills to be disposed, a recycle box for storing both deposited bills and bills to be dispensed, and an acceptance box with multi-compartments for sorted storing of bills;

wherein the acceptance box with multi-compartments has a fitting mechanism common to at least one of a fitting mechanism of the deposited bill box, the outgoing bill box and the recycle box;

wherein the acceptance box with multi-compartments has a slot in a same position to at least one of the deposited bill box, the outgoing bill box and the recycle box;

wherein the acceptance box with multi-compartments has a plurality of storages for storing bills conveyed in through a common slot;

wherein the plurality of storages are arranged in a horizontal direction within the acceptance box with multi-compartments, and at least two storages of the plurality of storages are arranged with an inclination in a same direction relative to a bottom surface of the acceptance box;

wherein the acceptance box with multi-compartments is arranged over the recycle box; and further comprising:

a lower bill conveyance mechanism fitted by linking the acceptance box with multi-compartments and the recycle box to a common conveyance path; and an upper bill conveyance mechanism arranged above the lower bill conveyance mechanism and including a cash slot for bills and a bill validator for validating bills.

15. A bill depositing/dispensing apparatus to which a plurality of storing boxes for storing bills may be fitted, comprising:

a lower bill conveyance mechanism provided with a common fitting mechanism having a plurality of storing boxes differing in the purpose of handling bills, and a plurality of storing/fitting units for detachably linking via the fitting mechanism the plurality of storing boxes to a common first conveyance path for conveying bills; and an upper bill conveyance mechanism arranged above the lower bill conveyance mechanism and including a cash slot for bills, a second conveyance path for conveying bills to the cash slot and linked to the first conveyance path of the lower bill conveyance mechanism, and a bill validator arranged on the second conveyance path;

wherein the plurality of storing boxes comprise a recycle box for storing both deposited bills and bills to be dispensed, and an acceptance box with multi-compartments provided with a plurality of storages for sorted storing of bills; and wherein the acceptance box with multi-compartments is arranged in the nearest position in the lower bill conveyance mechanism in the nearest position to the upper bill conveyance mechanism to store unrecycled bills judged by the bill validator.

16. The bill depositing/dispensing apparatus, as set forth in claim 15, wherein the plurality of storing boxes are provided with a discriminator for indicating information at least to discriminate the storing boxes, and the plurality of storing/fitting units have a detector for detecting information on the discriminator of each of the storing boxes.

17. A method of conveying and storing bills in a bill depositing/dispensing apparatus having a cash slot through which bills deposited by the user are fed or bills are discharged to the user, a bill validator, and a plurality of storing boxes which hold bills and are detachable in a horizontal direction, comprising the steps of:

providing an the acceptance box with multi-compartments which has a fitting mechanism common to at least one of a fitting mechanism of the deposited bill box, the outgoing bill box and the recycle box;

wherein the acceptance box with multi-compartments has a slot in a same position to at least one of the deposited bill box, the outgoing bill box and the recycle box;

wherein the acceptance box with multi-compartments has a plurality of storages for storing bills conveyed in through a common slot;

arranging the plurality of storages in a horizontal direction within the acceptance box with multi-compartments, and arranging at least two storages of the plurality of storages with an inclination in a same direction relative to a bottom surface of the acceptance box;

wherein the acceptance box with multi-compartments has a plurality of storages arranged in the horizontal direction within the acceptance box with multi-compartments; and conveying bills through the cash slot and validated by the bill validator, or conveying bills from any other storing box than the acceptance box with multi-compartments and validated by the bill validator, so as to be stored into one of the plurality of storages within the acceptance box with multi-compartments.

* * * * *